US008107837B2

(12) United States Patent
Hirai

(10) Patent No.: US 8,107,837 B2
(45) Date of Patent: Jan. 31, 2012

(54) IMAGE FORMING APPARATUS, CONTROL METHOD THEREOF, PROGRAM AND RECORDING MEDIUM

(75) Inventor: Shuji Hirai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 366 days.

(21) Appl. No.: 12/379,275

(22) Filed: Feb. 18, 2009

(65) Prior Publication Data

US 2009/0208233 A1 Aug. 20, 2009

(30) Foreign Application Priority Data

Feb. 19, 2008 (JP) ..... 2008-037968

(51) Int. Cl.
*G03G 15/00* (2006.01)

(52) U.S. Cl. ..... 399/49; 399/43; 399/44

(58) Field of Classification Search ..... 399/43, 399/44, 49, 60

See application file for complete search history.

(56) References Cited

U.S. PATENT DOCUMENTS

| | | | | |
|---|---|---|---|---|
| 6,353,716 | B1 * | 3/2002 | Uehara et al. | 399/44 |
| 6,975,338 | B2 | 12/2005 | Hirai et al. | |
| 7,035,559 | B2 * | 4/2006 | Tanaka et al. | 399/49 |
| 7,151,901 | B2 | 12/2006 | Hirai | |
| 7,193,642 | B2 | 3/2007 | Hirai et al. | |

FOREIGN PATENT DOCUMENTS

| | | | |
|---|---|---|---|
| JP | 3219882 | | 8/2001 |
| JP | 2003-84513 | | 3/2003 |
| JP | 2004-198805 | * | 7/2004 |
| JP | 2006-251406 | | 9/2006 |

* cited by examiner

*Primary Examiner* — Sandra Brase
(74) *Attorney, Agent, or Firm* — Harness, Dickey & Pierce, P.L.C.

(57) ABSTRACT

An image forming apparatus is provided which is of an electrophotographic type, and is capable of setting a gradation number of a patch pattern to be formed corresponding to various factor information, and to perform a process control. The image forming apparatus includes a patch pattern forming part to form a toner image of a patch pattern on an image carrier; a developing part to develop the patch pattern; a toner image density detecting part to measure a toner image density of the patch pattern; and a process control performing part to vary an image forming process condition based on detection results obtained from the toner image density detecting part, and to stabilize an image density.

17 Claims, 13 Drawing Sheets

OPTICAL SENSOR TO DETECT GRADATION PATTERNS

AN EXAMPLE OF DETECTION PATTERN

AN EXAMPLE OF DETECTION PATTERN

AN EXAMPLE OF DETECTION PATTERN

[WHEN DEVELOPMENT CHARACTERISTIC VARIES]

AN EXAMPLE OF DETECTION PATTERN

IMAGE FORMING APPARATUS, CONTROL METHOD THEREOF, PROGRAM AND RECORDING MEDIUM

CROSS-REFERENCE TO THE RELATED APPLICATION

This application is based on and claims the priority benefit of Japanese Patent Application No. 2008-037968, filed on Feb. 19, 2008, the disclosure of which is incorporated herein by reference in its entirety.

BACKGROUND OF THE INVENTION

1. Field of the Invention

The present invention relates to an image forming apparatus such as a copying machine, a laser beam printer, a facsimile, a plotter, or the like, a control method thereof, a program and a recording medium, particularly to an image forming apparatus wherein according to a detection result of a toner adhesion amount in toner adhesion patterns, a process control or a toner density control is performed.

2. Description of the Related Art

In an image forming apparatus of an electrophotographic type such as a copying machine, a printer, a facsimile, or the like, an image carrier including a photoreceptor is uniformly charged by a charger. A latent image is formed by an exposure device. Then, the latent image is developed by a developing unit, to be transferred by a transfer device to a transfer paper.

In the electrophotographic image forming apparatus of this kind, there is conventionally used a toner density control system, wherein toner adhesion patterns are formed in a non-image area of the image carrier, a density of the toner adhesion patterns is detected and measured by a photosensor of an optical reflection type and according to the detection results, toner supply from a toner supply device to the developing unit is controlled.

In the toner concentration control system, of output values of the optical reflection type-photosensor, for example, if an output value of the optical reflection type-photosensor corresponding to the toner adhesion patterns on the image carrier is represented by Vsp and an output value of the optical reflection type-photosensor corresponding to a toner non-adhesion part on the image carrier is represented by Vsg, generally, a toner supply control is performed so that Vsp/Vsg becomes a constant. When an amount of toner adhesion of the toner adhesion patterns decreases, Vsp/Vsg increases and a toner density of a developer in the developing unit is determined as low. Thereafter, the toner is supplied from the toner supply device to the developing unit. Conversely, when Vsp/Vsg is low, since the toner concentration of the developer in the developing unit is determined as high, the toner is not supplied. Thus, the concentration of the toner in the developing unit remains unchanged.

For example, as disclosed in Japanese Patent Application Publication Number 2006-251406, a toner density of a developer in a developing unit is detected. In accordance with Japanese Patent Application Publication Number 2006-251406, an image forming apparatus is configured to include a plurality of image carriers; a toner image forming device, whereby toner images in a plurality of colors are formed with toners of mutually different colors, on the plurality of image carriers, respectively; a transfer member to transfer the toner images, formed respectively on the plurality of image carriers, either to a surface of a transfer member moving a plurality of transfer positions facing the plurality of the image carriers respectively, or to a recording material carried on the surface of the transfer member; a plurality of toner image density detecting devices to detect respectively a toner adhesion amount, of toner patterns formed on the image carriers respectively and transferred on the transfer member, in a plurality of colors for image adjustment; and a controlling device which performs at least one of a process control to change an image forming condition, and a toner concentration control to change a toner supply amount, based on detection results of the toner adhesion amount of the toner adhesion patterns in the plurality of colors.

The plurality of image carriers are arranged to be aligned in a moving direction of the surface of the transfer member. The plurality of image density detecting devices are arranged in a direction intersecting the moving direction of the surface of the transfer member. The image forming apparatus further includes an apparatus state recognition device to recognize at least one of a use state and a use history of an apparatus main body. In accordance with the recognition result of the apparatus state, an array of the toner adhesion patterns in the plurality of colors, which is transferred and formed on the transfer member, is switched.

Furthermore, the image forming apparatus is configured in which an order of an image formation timing of the toner adhesion patterns in the plurality of colors is changed in accordance with the array of the toner adhesion patterns. As illustrated above, in accordance with the recognition result of the apparatus state, the array of the toner adhesion patterns in the plurality of colors, which is transferred and formed on the transfer member, is switched. Thus, according to the recognition result of the apparatus state, the optimum toner adhesion patterns can be generated and the image density thereof can be detected. Therefore, corresponding to the apparatus state of the image forming apparatus, the optimum toner adhesion patterns can be formed, and an image forming control can be performed.

In Japanese Patent Number 3219882, a process controlling device of an electrophotographic apparatus is disclosed, wherein a toner image density detecting device is provided to optically detect a density of a referential toner image generated on a photoreceptor. Based on detection results of the toner image density detecting device, respective parts of an electrophotographic process are controlled and a quality of an image formed is stabilized. In the process controlling device of the electrophotographic apparatus, an information processing device is provided to control the respective parts of the electrophotographic process, based on detection results obtained by the toner image density detecting device, after the referential toner image is formed between plural toner images for copying. To control the respective parts of the electrophotographic process, the above-mentioned information processing device gradually and sequentially alters control values of the respective parts of the process when the control values exceed predetermined values, so as to prevent a drastic change in image quality generated in the case of performing consecutive copying. In the process controlling device of the electrophotographic apparatus, deterioration in operation efficiency can be avoided because the process control is performed during intervals wherein the respective toner images are generated to form the image. In addition, since control data obtained from the referential toner image is immediately utilized to form a toner image for copying, the accuracy of the process control is enhanced. Furthermore, to control the respective parts of the electrophotographic process, since the information processing device is configured to perform the control gradually, drastic change in the image quality in the case of forming a plurality of images can be prevented. Thus, incongruous use of a copying machine by a user can be alleviated.

Meanwhile, due to a sensitivity deterioration of the photoreceptor with the lapse of time, or a sensitivity fluctuation of the photoreceptor resulting from an environment wherein the main body of the copying machine is used, or the like, under constant image forming conditions such as electrifying, exposure, developing, or the like, the image quality is unstable. Therefore, conventionally, a surface potential of the photoreceptor is detected by a potential sensor, etc., whereby the above-mentioned image forming conditions are controlled based on the detection results, so as to stabilize the image quality.

For example, in Japanese Patent Application Publication Number 2003-84513, an image forming apparatus is disclosed, which includes a toner cartridge attachable thereto and detachable therefrom; an electrifying device to apply an electrifying voltage to a photoreceptor drum; a developing voltage applying device to apply a developing voltage to a developing roller; and an image adjusting process control device. The toner cartridge includes a nonvolatile memory to record the printed sheets, a photoreceptor drum, a toner storage section, and a developing roller, which are integrally configured; a surface potential sensor to detect a surface potential of the photoreceptor drum; a toner concentration sensor to detect a toner concentration of detection patterns formed on the photoreceptor drum; and a toner end sensor to detect a toner amount in the above-mentioned cartridge. The image adjusting process control device adjusts an electrification output setting and a developing output setting, so that the surface potential detected by the surface potential sensor and the toner concentration detected by the toner concentration sensor reach prescribed values, in order to optimize an image output. The image adjusting process mode is performed by the image adjusting process control device whenever the number of printed sheets reaches a prescribed value, and the adjusted output value is recorded in the nonvolatile memory on the toner cartridge. In Japanese Patent Application Publication Number 2003-84513, it is also disclosed that both the number of printed sheets, as well as the electrifying output set value and the developing output set value are recorded in the above-mentioned nonvolatile memory, and that the image adjusting process control device selects a period to execute the image adjusting process mode, based on a variance between the output value and an estimated value. However, being comparatively expensive, the potential sensor is virtually only included in a top-of-the line image forming apparatus.

Meanwhile, in Japanese Patent Number 3219882, as illustrated above, the process controlling device of an electrophotographic apparatus is also disclosed, wherein the toner image density detecting device is provided to optically detect the density of the referential toner image generated on the photoreceptor. Based on detection results of the toner image density detecting device, respective parts of the electrophotographic process are controlled and the quality of the image formed is stabilized. In the process controlling device of the electrophotographic apparatus, there are also provided an internal temperature detecting device, to detect a temperature inside the electrophotographic apparatus; as well as a frequency control device to control a frequency at which the respective parts of the electrophotographic process are controlled, when a temperature, detected by the internal temperature detecting device, differs from a temperature detected, at which the respective parts of the electrophotographic process are controlled last time, by a predetermined value, in order to control the respective parts of the electrophotographic process once again. Thus, the process control is performed corresponding to a temperature variation in the electrophotographic apparatus. Accordingly, on the one hand, the process can be controlled less frequently; on the other hand, drastic change in the image quality can be prevented. Therefore, for one thing, an undesirable increase in toner consumption can be prevented; and for another, the accuracy of the process control can be enhanced, whereby the optimization of the image forming can be achieved.

To summarize, as illustrated above, the process control can be variably or flexibly performed corresponding to the state of the image forming apparatus. However, when focusing on varying parameters of gradation patterns, few reference documents can be referred to other than Japanese Patent Application Publication Number 2006-251406. Conventionally, although an image forming apparatus with a small gradation number used for the process control is commercially available, the gradation number is invariable, namely, the gradation number cannot be varied corresponding to the state of the apparatus. When the gradation number is small and invariable, even a development characteristic differs greatly from a typical one, a measurement of the development characteristic cannot be performed appropriately. Consequently, the process control may not be performed successfully.

SUMMARY OF THE INVENTION

The present invention has been accomplished in view of the hitherto unsolved problems of the prior technology and it is an object of the present invention to optimize a process control via regularly detecting a surface potential of a photoreceptor and a toner image density, and via adjusting electrification as well as a developing output. In general, a correct process control is performed by measuring a development characteristic with the use of gradation patterns with a large gradation number. However, when the development characteristic is speculated to hardly fluctuate, via the process control with the use of gradation patterns with a small gradation number, the process control is performed appropriately, whereby a reduction of both a toner consumption amount and the time for the process control is expected to be realized.

In order to achieve the above object, an image forming apparatus according to an embodiment of the present invention includes a patch pattern forming part to form a toner image of a patch pattern on an image carrier; a developing part to develop the patch pattern; a toner image density detecting part to measure a toner image density of the patch pattern; and a process control performing part to vary an image forming process condition based on detection results, and to stabilize an image density. The process control performing part is configured to set a gradation number of the patch pattern formed, corresponding to various factor information.

DETAILED DESCRIPTION OF THE PREFERRED EMBODIMENTS

Preferred embodiments of the present invention will be described in detail below with reference to the accompanying drawings.

Figure 1:
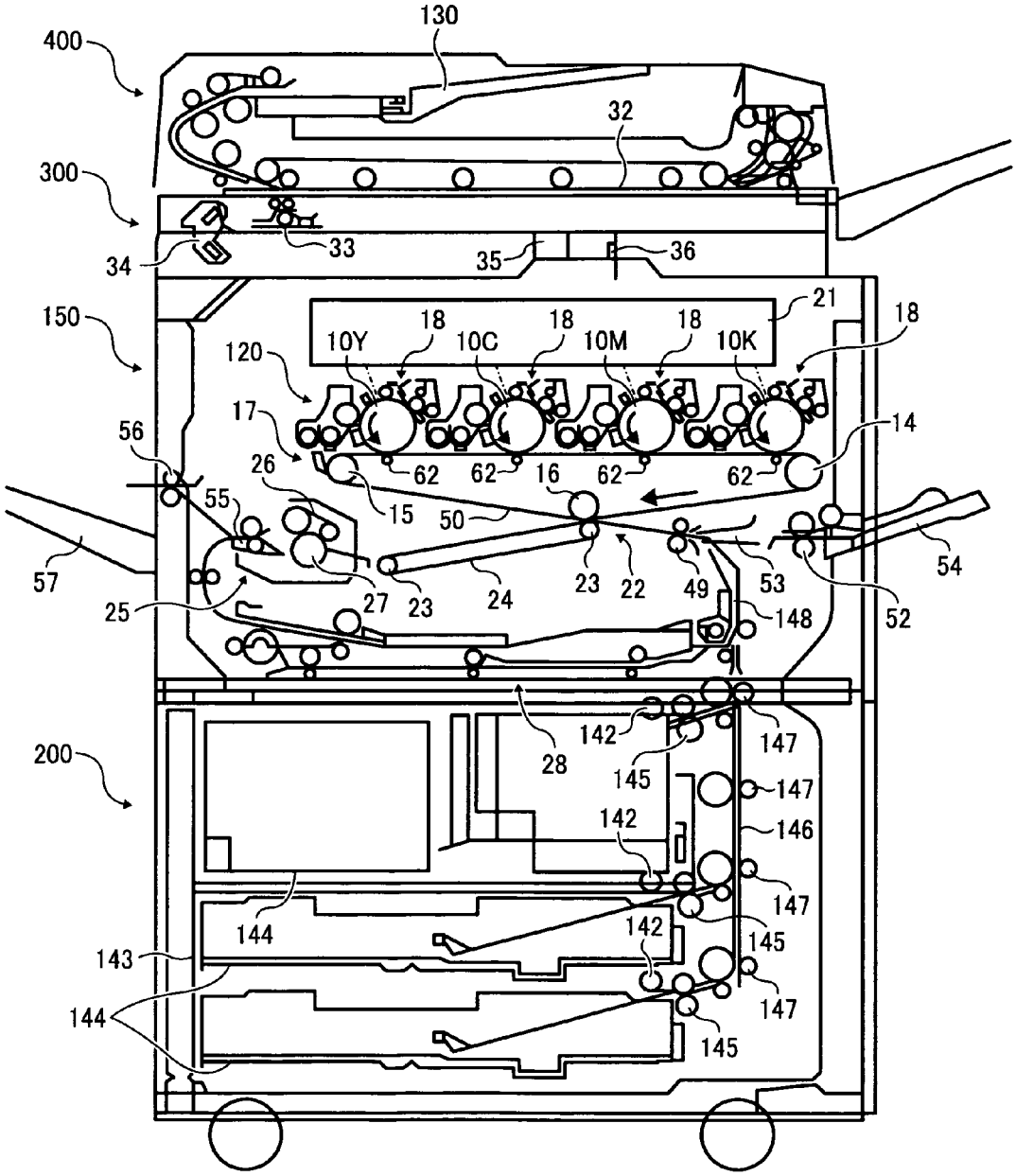
FIG. 1 shows a schematic configuration of an image forming apparatus equipped with a process control of the present invention.

FIG. 1 is a schematic view of an image forming apparatus according to the present invention, wherein a process control can be performed. In the illustrated embodiment, the image forming apparatus is formed as a tandem-type image forming apparatus. The tandem-type image forming apparatus includes a copying apparatus main body 150, a paper feed table 200, a scanner 300, and an auto document feeder (ADF) 400. Here, as a representative example of an electrophotographic image forming apparatus, although a quadruple tandem-type full-color copying machine with an intermediate transfer system is illustrated, it is not limited thereto. A quadruple tandem-type full-color copying machine with a direct transfer system or one-drum type full-color copying machine of an intermediate transfer system, etc., or a monochromatic copying machine with the direct transfer system can also be used as an alternative.

A configuration of the image forming apparatus and an image forming process will be illustrated in detail hereinafter with reference to FIG. 1.

As illustrated in FIG. 1, at a central position of the copying machine main body 150, an endless belt-shaped intermediate unit (an intermediate transfer belt) 50 is provided. The intermediate transfer unit 50 is stretched by three supporting rollers 14, 15, and 16, and can be rotated clockwise, as illustrated in FIG. 1. In the vicinity of the supporting roller 15, a cleaning unit 17 of the intermediate transfer unit is provided, so as to remove the residual toner on the intermediate transfer unit 50. On the intermediate transfer unit 50, stretched by the supporting rollers 14 and 15, tandem developing units 120 are provided to be aligned in the conveyance direction of the intermediate transfer unit 50, opposite to four image forming units 18 for the colors of yellow, cyan, magenta and black. In the vicinity of the tandem developing units 120, an exposure device 21 is provided. At the opposite side of the tandem developing units 120 with respect to the intermediate transfer unit 50, a secondary transfer device 22 is disposed.

In the secondary transfer device 22, a secondary transfer belt 24 which is an endless belt is stretched by a pair of rollers 23. A transfer paper conveyed by the secondary transfer belt 24 can contact with the intermediate transfer unit 50 (intermediate transfer belt). In the vicinity of the secondary transfer device 22, a fixing device 25 (fixing unit) is provided. The fixing device 25 includes a fixing belt 26 which is an endless belt, and a pressure roller 27, which is pressed against the fixing belt 26. In addition, in the tandem-type image forming apparatus, in the vicinity of the secondary transfer device 22 and the fixing device 25, a sheet reversing device 28 is provided to reverse the transfer paper, so as to form an image on both sides of the transfer paper.

Next, an image forming operation (color copying operation) will be illustrated concerning a full-color image when the tandem-type image forming apparatus, whose configuration is described in FIG. 1, is used. First, a document can be set on a document platen 130 of the auto document feeder (ADF) 400. Alternatively, after the auto document feeder 400 is opened, the document can also be set on a contact glass plate 32, whereafter the auto document feeder 400 is closed.

When a start switch (not shown) is pressed to start the printing, each roller in the vicinity of the photoreceptor 10, in the vicinity of the intermediate transfer belt 50, or at a paper feeding transporting path, etc. is started to be rotated at a predetermined timing. When the document is set in the auto document feeder 400, the document is conveyed and moved onto the contact glass plate 32, whereafter the scanner 300 is driven and a first moving body 33 and a second moving body 34 are moved. When the document is set on the contact glass plate 32, the scanner 300 is driven immediately and the first moving body 33 and the second moving body 34 are moved. The document is illuminated by light emitted from a light source via the first moving body 33. Then, reflected light from the document surface is reflected by a mirror of the second moving body 34, whereafter the reflected light is received by a reading sensor 36 through an image forming lens 35, to read the color document (as color image). Then, image information corresponding to black, yellow, magenta and cyan is obtained.

Figure 2:
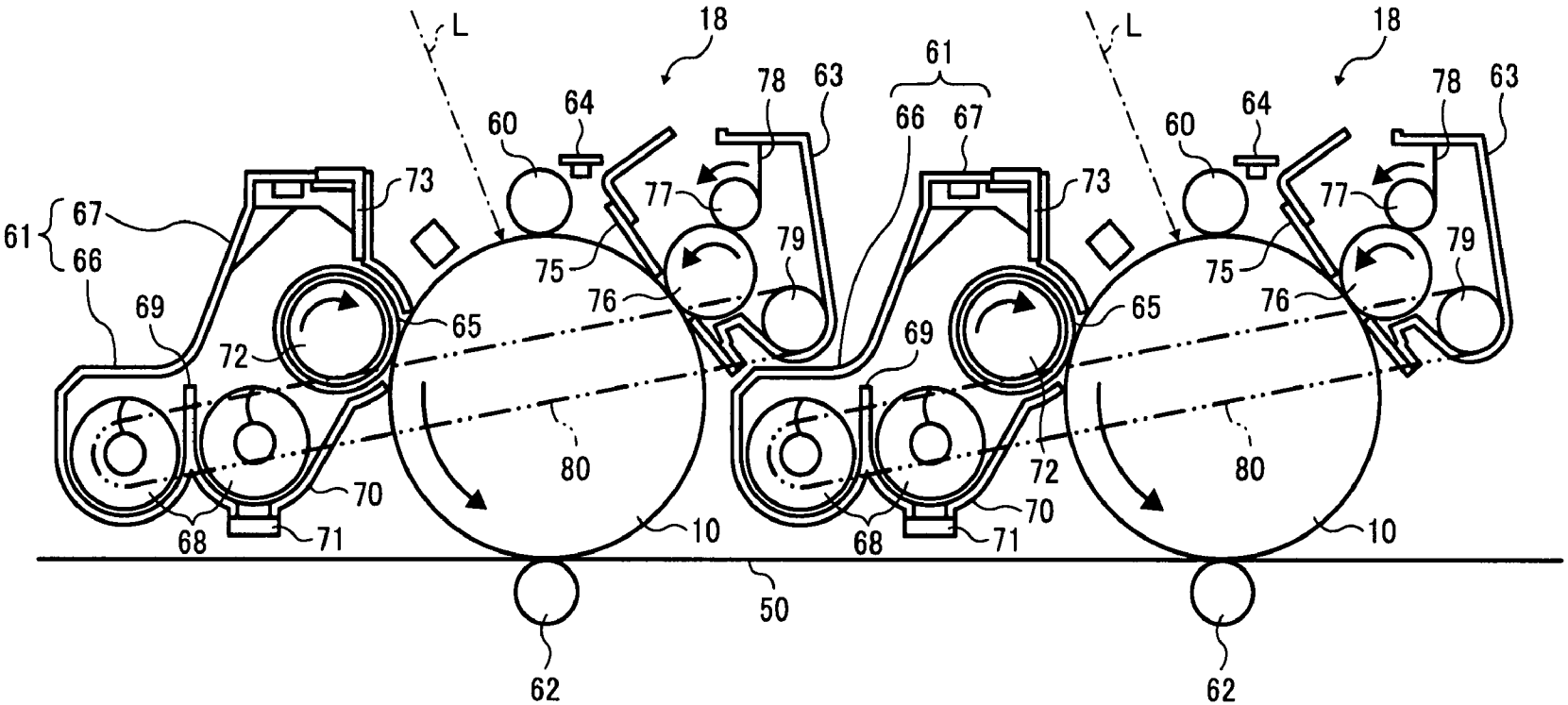
FIG. 2 is an enlarged view illustrating a configuration of an image forming device of the image forming apparatus exemplified.

Then, the image information corresponding to black, yellow, magenta and cyan is transmitted respectively to the respective image forming units 18 (the image forming unit for the black color, the image forming unit for the yellow color, the image forming unit for the magenta color, and the image forming unit for the cyan color) in the tandem-type image forming apparatus. Thereafter, toner images in black, yellow, magenta and cyan are formed respectively on the respective image forming units 18. The image forming units 18 may be used as a patch pattern forming part constituting the image forming apparatus. Namely, when part (two image forming units) of the image forming units 18 are enlarged, as illustrated in FIG. 2, the image forming units 18 (the image forming unit for the black color, the image forming unit for the yellow color, the image forming unit for the magenta color, and the image forming unit for the cyan color), in the tandem image forming apparatus, include the plural photoreceptors 10 (a photoreceptor 10K for the black color; a photoreceptor 10Y for the yellow color; a photoreceptor 10M for the magenta color; and a photoreceptor 10C for the cyan color); a plurality of chargers 60 to uniformly electrify the surfaces of the plural photoreceptors 10; and exposure units to form the electrostatic latent images corresponding to the four colors, respectively. The plural photoreceptors 10 are exposed (in FIG. 2, reference character L is used) in order to form color images, based on the image information of the four colors.

Namely, the surface of each photoreceptor 10 is uniformly electrified by each charger 60. A colotron device, a scolotron device, a solid-state discharging element, a needle electrode device, a roller charging device, a conductive brush device, or the like can serve as the chargers 60, to uniformly electrify the photoreceptors 10. The heretofore known contact-type electrification method or the proximity electrification method can be used for electrification.

Here, the contact-type electrification method refers to an electrification method where a charging roller, a charging brush, a charging blade, etc. are in direct contact with a photoreceptor. The proximity electrification method is a method where although the charging roller and the photoreceptor are disposed in proximity to each other, the charging roller is not in contact with a surface of the photoreceptor, with a gap equal to or less than 200 μm therebetween. When the gap width is excessively large, the electrification process tends to be unstable; whereas when the gap width is excessively small, the surface of the charging member may be contaminated by the residual toner existing on the photoreceptor. Therefore, the gap width is preferably between 10 μm and 200 μm. The gap width is further preferably between 10 μm and 100 μm.

The uniformly electrified surfaces of the photoreceptors 10 are exposed by the writing light emitted from the exposure device 21 (optical writing unit), whereby the electrostatic latent images are formed. The light source for the exposure device 21 can be a fluorescent lamp, a tungsten lamp, a halogen lamp, a mercury lamp, a sodium lamp, a light-emitting diode (LED), a laser diode (LD), an electroluminescence (EL), or the like. In order to obtain only the writing light whose wavelength falls within a desired range, a sharp cut-off filter, a band-pass filter, a near infrared cut filter, a dichroic filter, an interference filter, a color temperature conversion filter, or the like can be used.

Potential patterns obtained after the exposure are referred to as the electrostatic latent images. The toners are supplied by a plurality of developing devices 61 (a developing unit), which are to visualize the electrostatic latent images carried on the photoreceptors 10, whereby each of the carried electrostatic latent images is developed in a specified color. The plurality of developing devices 61 may be used as a developing part constituting the image forming apparatus. A developing method includes a one-component developing method where a dry toner is used, a two-component developing method where the dry toner is used, and a wet development method using a wet toner. When the positive (negative) electrification is executed on the photoreceptors 10 and the exposure is performed, positive (negative) electrostatic latent images are formed on the surfaces of the photoreceptors. When the electrostatic latent images are developed by using negatively (positively) polarized toners, positive electrostatic latent images are obtained; whereas when positively (negatively) polarized toners are used, negative electrostatic latent images are obtained. As illustrated in FIG. 1, since there are four photoreceptors (the color order of the photoreceptors may vary) for the black color, the yellow color, the magenta color, and the cyan color, the toner images in yellow, magenta, cyan, and black are formed on the photoreceptors respectively.

As illustrated in FIG. 2, developing units 61 to form toner images of the four colors by using toners of the four colors (a black toner, a yellow toner, a magenta toner, and a cyan toner); transfer chargers 62 to transfer the toner images to the intermediate transfer belt 50; photoreceptor cleaning units 63 and neutralization devices 64 are provided. Therefore, based on the color image information of each color, each monochromatic image (a black image, a yellow image, a magenta image, and a cyan image) can be formed.

A primary transfer bias is applied to a primary transfer roller, disposed to be opposed to the photoreceptors 10. Via the primary transfer bias and a suppress strength, at contact points where the toner images (the black toner image, the yellow toner image, the magenta toner image, and the cyan toner image) are formed (developed) on the plural photoreceptors 10 and contact the intermediate transfer unit 50 (intermediate transfer belt), and are rotationally moved by the supporting rollers 14, 15 and 16, the black toner image formed on the photoreceptor 10K, the yellow toner image formed on the photoreceptor 10Y, the magenta toner image formed on the photoreceptor 10M, and the cyan toner image formed on the photoreceptor 10C are sequentially transferred (a primary transfer) to the intermediate transfer unit 50. Such an operation of the primary transfer is performed in exact timing for the four colors repeatedly, whereby the black toner image, the yellow toner image, the magenta toner image, and the cyan toner image are overlapped and a composite color toner image (full-color toner image) is formed accordingly.

Meanwhile, in the paper feed table 200, positioned at the lower part of the image forming apparatus, one of paper feed rollers 142 is selectively rotated, whereby paper (recording paper) feed is started from paper feed trays provided in a paper bank 143. The recording paper is pulled out of one of paper cassettes 144, and then is guided to a paper feed path 146 after being separated by separation rollers 145 sheet by sheet. Then the recording paper is conveyed by conveyance rollers 147, and is guided to a paper feed path 148 in the copying machine main body 150, whereafter the paper hits and is stopped by a resist roller 49. Alternatively, the paper feed rollers 142 are rotated to pull out the sheets (recording paper) on a manual insertion tray 54. Then the paper is separated by a separation roller 52 sheet by sheet to be fed into a manual insertion path 53, whereafter the paper hits and is stopped by the resist roller 49 likewise. In addition, generally, the resist roller 49 is used after being grounded. In order to remove paper powder, the resist roller 49 can also be used with a bias applied thereon.

Then the resist roller 49 is rotated with the timing of the composite color toner image formed on the intermediate transfer unit 50. Between the intermediate transfer unit 50 and the secondary transfer device 22, the paper is discharged, whereon the composite color toner image is transferred (secondarily transferred) by the secondary transfer device 22. Thus, the composite color toner image is transferred on the recording paper. At this time, a secondary transfer is performed via a secondary transfer bias applied on a secondary transfer roller and a suppress strength. After the image is transferred, the residual toners on the intermediate transfer unit 50 are cleaned by the cleaning unit 17 of the intermediate transfer unit.

The recording paper whereon the above-mentioned color toner image is transferred, is conveyed by the secondary transfer device 22, to be discharged to the fixing device (fixing unit) 25, whereby the composite color toner image is subjected to heat and pressure to be heat-fixed on the recording paper. Then, switching is performed by a switching claw 55 so that the recording paper is ejected by an ejecting roller 56 and then is stacked on a copy receiving tray 57. Alternatively, switching is performed by the switching claw 55 so that the recording paper is reversed by a sheet reversing device 28 and is fed to the secondary transfer device 22 again so that the toner image is recorded on the back side of the recording paper as well. Thereafter, the recording paper is ejected by the ejecting roller 56, and then is stacked on the copy receiving tray 57.

Namely, in the case of a single-side printing, the recording paper is linearly conveyed to the copy receiving tray; whereas in the case of the double-side printing, the recording paper is conveyed to the sheet reversing device 28, where a transporting direction is changed to be downward. The conveying direction of the recording paper is reversed at the sheet reversing device 28, therefrom the recording paper exits from a rear end thereof. Such an operation is referred to as a switchback operation, whereby the recording paper can be reversed. The reversed recording paper passes a paper re-feed transporting path, instead of returning to a direction of the fixing unit 25, to join the original paper feed path.

Thereafter, as in the case of the single-sided printing, a toner image is transferred. The recording paper, whereon the toner image is transferred, is ejected after passing the fixing unit and is stacked on the copy receiving tray 57. The double-side printing is illustrated as above.

Since after a primary transfer process, residual toners may adhere undesirably to the surfaces of the photoreceptors, the residual toners are removed by the photoreceptor cleaning units 63 (or the cleaning unit 17 of the intermediate transfer unit), including blades, brushes, etc. Thereafter, surfaces of the photoreceptors are uniformly discharged by quenching lamps (QL) provided in the neutralization devices 64, so as to prepare to be electrified for a subsequent image forming. Meanwhile, since after a secondary transfer process residual toners may also undesirably adhere to the surface of the intermediate transfer belt, the residual toners are removed by the cleaning unit 17 of the intermediate transfer unit, including a blade, a brush, etc., as preparation for a subsequent toner image transfer. Such operation is repeatedly performed, whereby the single-side printing or the double-side printing is executed.

Incidentally, in the image forming apparatus according to the embodiment of the present invention, a process cartridge may be used as a main section to form the toner image. Specifically, the process cartridge is configured by combining integrally the above-mentioned electrophotographic photoreceptor, the developing unit, the cleaning unit, or the like, and is detachably attached to the apparatus main body. Alternatively, the process cartridge is formed by integrally supporting at least one of the charger, an exposure device, the developing unit, a transfer separator and a cleaning unit, together with an electrophotographic photoreceptor, as a separate unit detachably attached to the apparatus main body via a guide unit such as a rail of the apparatus main body.

Figure 3:
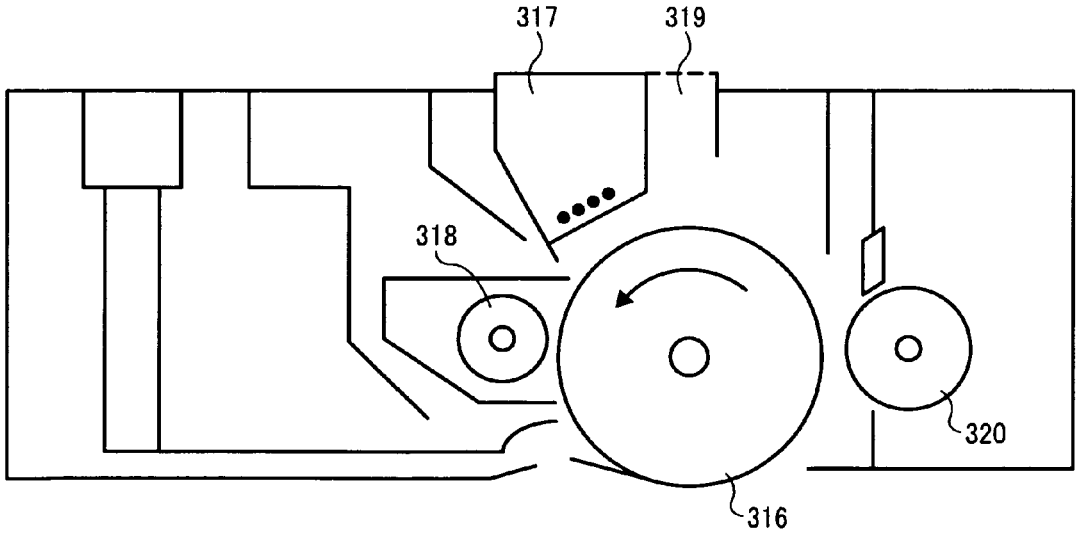
FIG. 3 illustrates a configuration example of a process cartridge provided in the image forming apparatus.

As illustrated in FIG. 3, such a process cartridge includes a built-in photoreceptor 316, a charger 317, an exposure device 319, a developing unit 320, a cleaning unit 318, a transfer device (not shown), a neutralization device (not shown), and other necessary devices. The above-mentioned developing unit 320 includes at least a developer container to store a toner or a developer, and a developer carrier to carry and transport the toner or the developer stored in the developer container, or may further include a layer thickness control member to control a toner layer thickness carried. The above-mentioned process cartridge can be detachably attached to various image forming apparatuses and is preferably detachably attached to the image forming apparatus according to the embodiment of the present invention.

When the process cartridge illustrated in FIG. 3 is used, an image forming process can be illustrated as follows. The photoreceptor 316 is rotated clockwise to be electrified by the charger 317. Thereafter, an exposure image is formed via an exposure by the exposure device 319. The electrostatic latent image corresponding to the exposure image is formed on the surface of the photoreceptor 316. This electrostatic latent image is developed by the developing unit 320 as a toner image, whereafter the developed toner image is transferred by the transfer device (not shown) onto a recording medium to be printed out. Thereafter, the surface of the photoreceptor 316 is cleaned by the cleaning unit 318, and then is neutralized by the neutralization device (not shown). The above-mentioned image forming process is performed repeatedly. Thus, the image forming apparatus can be configured to be provided with such a process cartridge including at least the electrophotographic photoreceptor, the developing unit to visualize the electrostatic latent image formed on the electrophotographic photoreceptor by using the toner. The charger, the developing unit, the transfer device, the cleaning unit, and the neutralization device, or the like may be further included in such a process cartridge when necessary.

Figure 4:
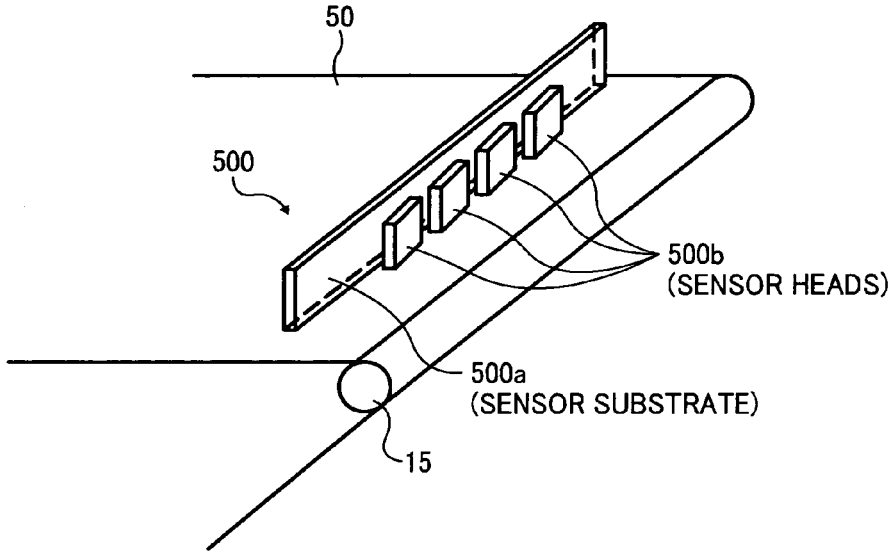
FIG. 4 is a configuration example of an optical sensor to detect the gradation patterns and an image carrier whereon the gradation patterns are formed.

Next, characteristics of the embodiment illustrated in FIG. 1 will be explained in detail hereinafter. In the above-mentioned image forming process, in order to stabilize an image density, toner adhesion patterns (gradation patterns) are formed on a non-image area of the image carrier. A density of the toner adhesion patterns is detected by an optical sensor, whereafter based on detection results, toner supply is controlled from a toner supply device to the developing unit. Particularly, a gradation number of the gradation patterns (detection patterns) formed is made variable. A process control is performed to set the gradation number in accordance with various factors of starting image forming process control. First, the process control employing gradation patterns (images) will be illustrated. FIG. 4 illustrates a configurative example of the configuration of an optical sensor 500 (connecting lines are omitted), included in a toner image density detecting part constituting the image forming apparatus to detect the gradation patterns (in cooperation with a suitable processing electrical circuit section not shown), and the arrangement of the image carrier (intermediate transfer belt 50), whereon gradation patterns are formed. In this configurative example, the image carrier whereon the gradation patterns are formed is the intermediate transfer belt 50. The optical sensor 500 to measure the toner adhesion amount is arranged to be opposed to an outer peripheral surface of the intermediate transfer belt 50. In the optical sensor 500, four sensor heads 500*b*, corresponding to the respective colors in the full-color copying machine, are arranged on a single sensor substrate 500*a*.

In addition, another configuration of the optical sensor 500 can be illustrated as follows. Only one sensor head 500*b* is arranged. Gradation patterns of the respective colors are all sequentially formed in a same position in a width direction of the intermediate transfer belt 50, which are to be read by the sensor head 500*b*. Of course, in the case of a monochromatic copying machine, since only gradation patterns of the black color are to be detected, only one sensor head 500*b* is formed. The gradation patterns are not confined to be formed only on the intermediate transfer belt 50. The gradation patterns can also be formed on the photoreceptors 10, a transfer and transport belt (a transport belt to transport paper, which is arranged to be opposed to an array of the photoreceptors of a tandem-type full-color copying machine, with the direct transfer system).

Figure 5:
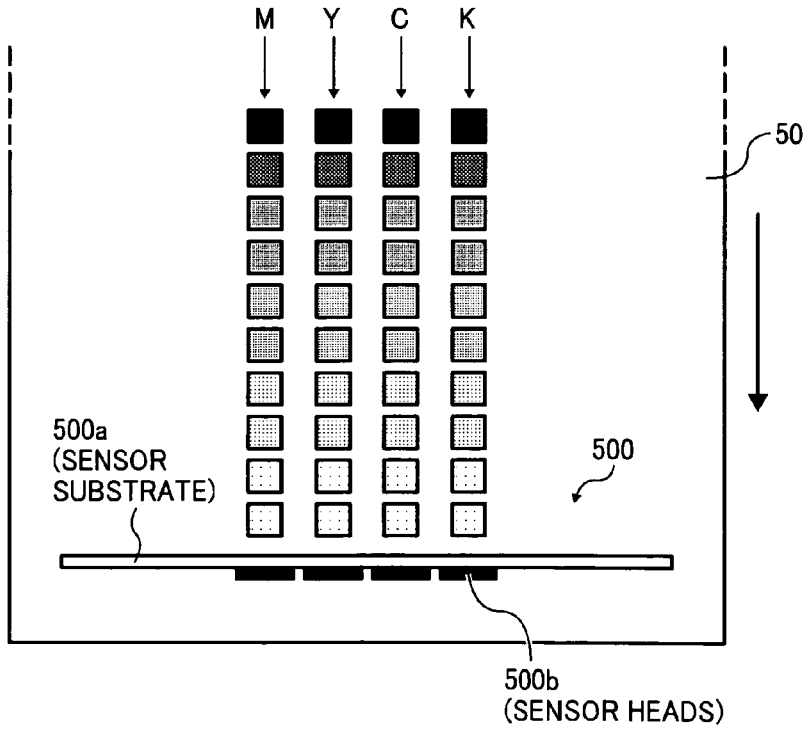
FIG. 5 is a top view of illustrating an example of the gradation patterns, with the configuration illustrated in FIG. 4.

FIG. 5 is a top view of the configuration illustrated in FIG. 4, to illustrate an example of the gradation patterns (the detection patterns), formed on the intermediate transfer belt 50. The sensor head 500*b* includes four heads corresponding to the four colors (yellow, black, cyan, magenta) respectively. 10-level gradation patterns corresponding to the four colors respectively are formed in a width direction on the intermediate transfer belt. A standard gradation number is substantially 10, although copying machines may differ in the gradation number. In the case wherein even if the development characteristic fluctuates to some extent due to environment changes and deterioration of the developer and the photoreceptor over time, the 10-level gradation pattern is preferred in order to make a patch pattern be securely formed from a low image density area to a high image density area, and to securely calculate a development gamma γ, considered as a feature of a development characteristic.

In some models of the commercially available image forming apparatus, a small gradation number (the gradation number being 4 or 5) is used to measure the development characteristic. However, when a robustness of the development characteristic is low, even if every time a gradation pattern with a developing potential is formed corresponding to the largest gradation number (for example, 5), a gradation pattern developed may undesirably be biased toward a high density side or a low density side. In such a case, since data of a halftone part cannot be collected adequately, a value of the development gamma γ may not be correctly calculated therewith. Therefore, the 10-level gradation pattern is necessary since even if the development characteristic fluctuates as mentioned above, the halftone part is unfailingly included in a toner image density region formed as the gradation patterns. The same consideration also applies to the case illustrated hereinafter wherein one sensor head is commonly utilized for the four colors (see FIG. 15 for reference) to detect the gradation patterns. Since only one sensor head is arranged for the four colors, the gradation patterns of the respective colors are formed serially.

Figure 15:
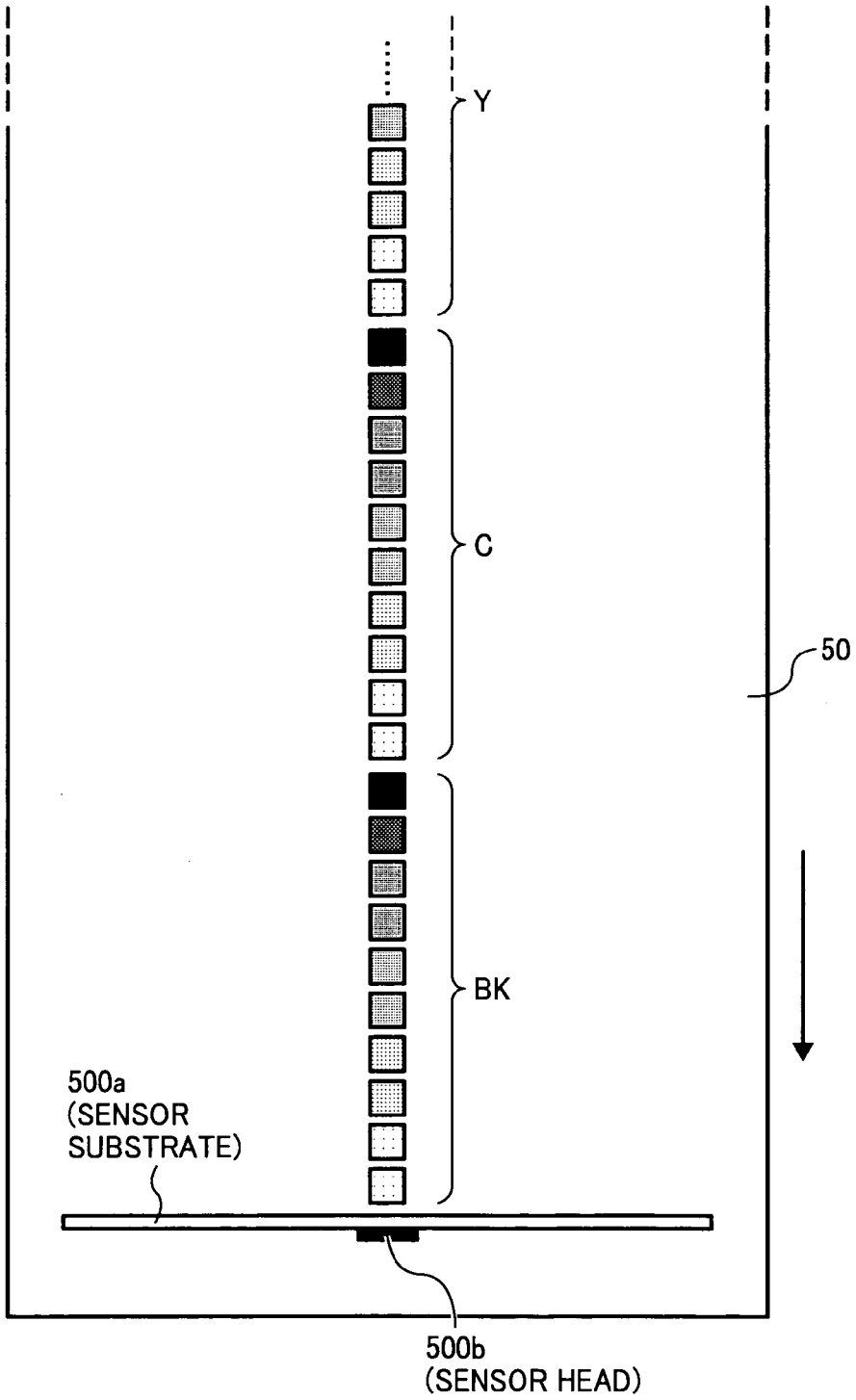
FIG. 15 is a top view illustrating an example of gradation patterns when a sensor head which is common for colors of black, yellow, cyan, and magenta is used.

Here, one way to change the gradation number of the gradation patterns formed when the image forming process control is performed is to vary the gradation number 10 of the 10-level gradation pattern, as illustrated in FIGS. 5 and 15, depending on different cases. Generally, the process control is principally performed according to a largest gradation number in default (for example, the gradation number is 10). However, at the start of the process control (strictly speaking, the start of the process control includes a start of the gradation patterns forming processing repeatedly performed at a predetermined interval), when from various factors, the variation in the development characteristic can be determined as small, the gradation number can be reduced.

Figure 6A:
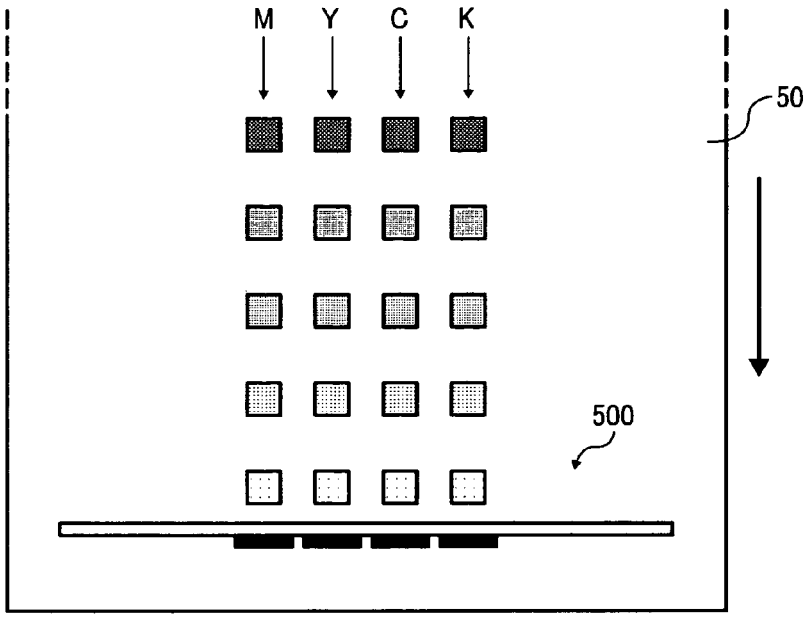
FIGS. 6A, 6B are top views illustrating two examples in which a number of the gradation patterns is reduced respectively.
Figure 6B:
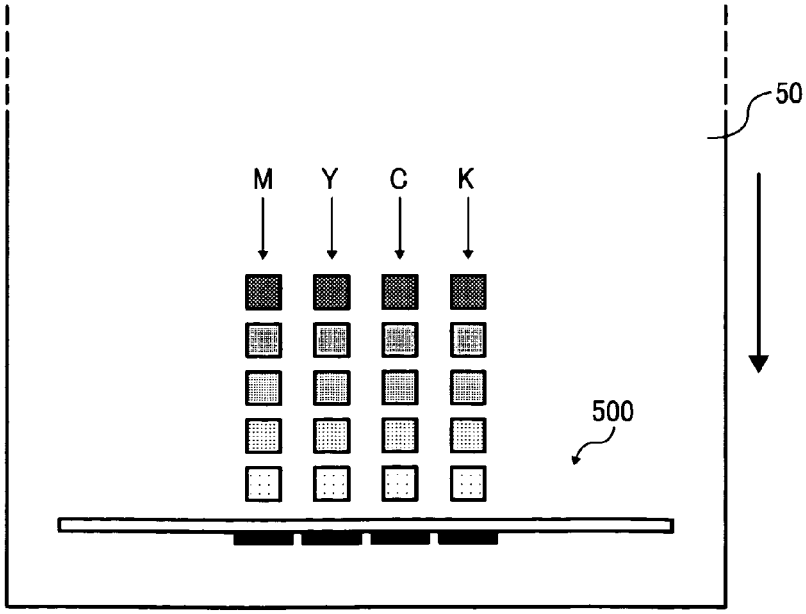

FIGS. 6A and 6B illustrate examples of gradation patterns formed respectively when the gradation number is reduced from the default state illustrated in FIG. 5. FIG. 6A illustrates an example in which the gradation number is reduced to 5 (namely the number of the gradations is reduced to 5). The 5-level gradation patterns of a same gradation degree as that in FIG. 5 are formed at same positions in the conveyance direction of the intermediate transfer belt. FIG. 6B illustrates another example in which the gradation number is also reduced to 5, (namely the number of the gradations is 5), as that in FIG. 6A with the same gradation degree. However, the 5-level gradation pattern is formed at mutually closer positions in the conveyance direction of the intermediate transfer belt.

In addition, in the case wherein the gradation patterns are formed having a reduced gradation number, the gradation patterns are not necessarily formed with equal intervals (namely the gradation patterns are not necessarily linearly formed). Furthermore, the gradation patterns can also be formed by using a partial range of the full gradation degree.

For example, the gradation patterns can be formed via using a central gradation degree part instead of adopting the gradation degree including an upper or a lower degree. In a word, as long as the gradation patterns are formed and evaluated for an effective process control, a different gradation interval and different gradation degree can be used.

Thus, via reducing the gradation number, it is advantageous that both the consumption of the toner amount and the time required for the process control be reduced. However, meanwhile, when the development characteristic varies, the development gamma γ value may not be correctly calculated.

Figure 7:
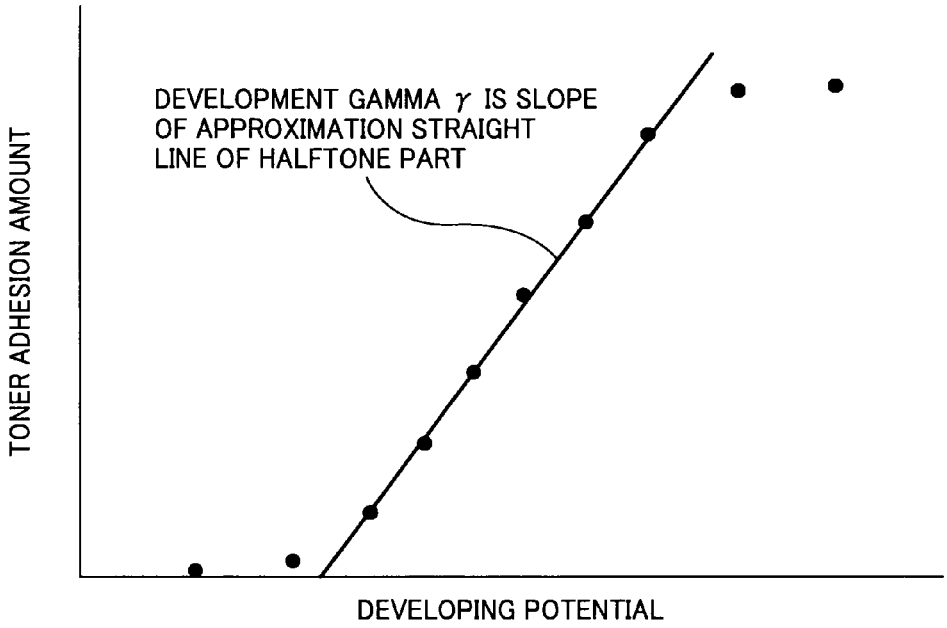
FIG. 7 illustrates an image of calculating a development gamma γ.

In FIG. 7, an image of calculating the development gamma γ is illustrated. The gradation patterns formed when the development gamma γ is calculated are analog patterns in general. Generally, the printed image is a digitally formed image. However, the patch patterns, which are analog gradation patterns, are formed by varying the developing capacity sequentially to vary the toner image density of the patch patterns, with every toner image of each patch being a solid image at every level of gradation. Since the development gamma γ is an index value indicating a developing capability, generally, the above-mentioned method is used wherein gradation patterns are formed. Specifically, for most cases, switching the developing capability involves switching a developing bias. When the developing bias is switched, the electrostatic developing capability is changed and is referred to as a developing potential. In FIG. 7, a horizontal axis represents the developing potential, and a vertical axis indicates the toner adhesion amount measured by the optical sensor. When the 10-level gradation pattern, as the analog gradation pattern is formed, 10 plots are taken, as illustrated in FIG. 7.

In order to evaluate an image quality of an image output from the image forming apparatus, several indexes are used, one of which is a gradation reproducibility of the halftone part. Via determining an approximate straight line from plots of the halftone part, a slope of the approximate straight line can be obtained. This slope is a value of the development gamma γ, which serves as an index value of the developing capability. When the γ value is excessively large (the approximate straight line inclines steeply), even a slight fluctuation in the developing potential may cause the toner image density to vary. Consequently, the reproducibility of the halftone part is lowered. Conversely, if the approximate straight line inclines excessively gently, although a subtle difference in the toner image density can be reproduced, a solid density may not be adequate. In short, since problems may arise when the γ value is excessively large or small, the γ value is desirably confined within a certain range.

Figure 8:
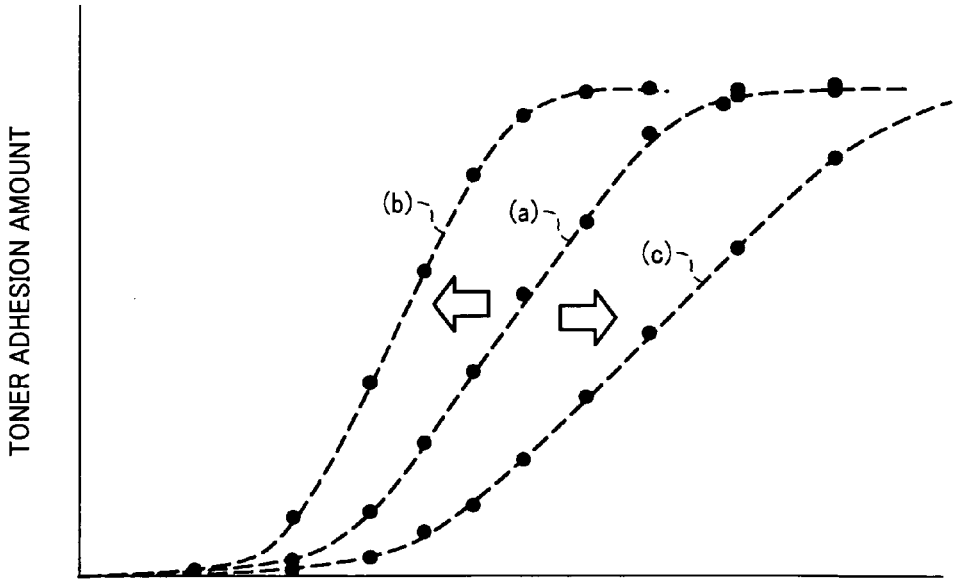
FIG. 8 illustrates an influence on the calculation of the development gamma γ when a development characteristic varies.

FIG. 8 illustrates an influence on the calculation of the development γ. when the development characteristic varies. The development characteristic varies over time or temporarily mainly due to the deterioration of the developer or the photoreceptor, the environment change, etc. In FIG. 8, if a typical development characteristic is represented by a dotted-line graph, i.e. line (a) in FIG. 8, when a charge amount of the developer is lowered, and the developing capability becomes excessively high, the graph of the development characteristic, i.e. line (a) in FIG. 8 shifts to a dotted line graph, i.e. line (b)

in FIG. 8 on a left side. Conversely, in FIG. 8, when the developing capability becomes low, the graph of the development characteristic, i.e. line (a) in FIG. 8 shifts to a dotted-line graph, i.e. line (c) in FIG. 8. Such a shift can be set to be large or small, and cannot be eliminated as long as an electrophotographic process is employed. The process control is to eliminate the influence of the development characteristic which fluctuates, as illustrated above.

As illustrated in FIG. 7, the 10 plots are obtained and are illustrated on the dotted-line graph, i.e. FIG. 8A when the 10-level gradation pattern is read. When the graph of the development characteristic is shifted, the 10 plots are also indicated on the dotted-line graph, i.e. FIGS. 8B and 8C, respectively. As illustrated in FIG. 8, when the development characteristic is measured by using the 10-level gradation pattern, since several plots are included on a gradient portion of the approximate straight line, even if the development characteristic varies at some degree, the calculation of the development gamma γ is hardly influenced.

Figure 9:
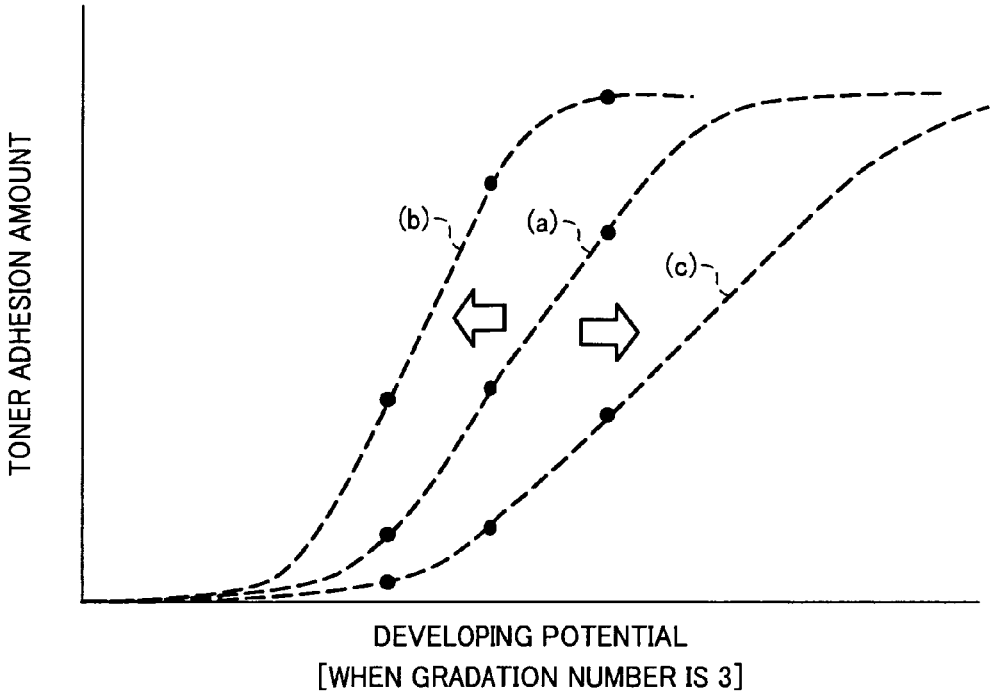
FIG. 9 illustrates plots in the case of a 3-level gradation pattern.

FIG. 9 is obtained by plotting to illustrate a case of a 3-level gradation pattern. In this case, all of three plots are on a straight line of the halftone part of a dotted-line graph, i.e. line (a) of FIG. 9, which illustrates the typical development characteristic. When the development characteristic is fluctuated (as in the cases of dotted lines (b) and (c) in graph 9, one plot of the three plots is deviated from the straight line. If only the three plots are used to obtain an approximate straight line, a rather unignorable error may be included in the development γ, which is the slope of the approximate straight line.

Therefore, in this case, although the slope of the approximate straight line should be calculated by using two plots thereon, the error becomes rather unignorable. In addition, it is intrinsically difficult to appropriately select the two plots when there exists only three plots (As illustrated in the dotted line FIG. 9, since the development characteristic cannot be estimated in advance, when the three plots disperse, which should be all on the straight line, it is difficult to identify the reason for the dispersion of the three plots, which may either be the error, or approaching an inflection point of the development characteristic.)

Figure 10:
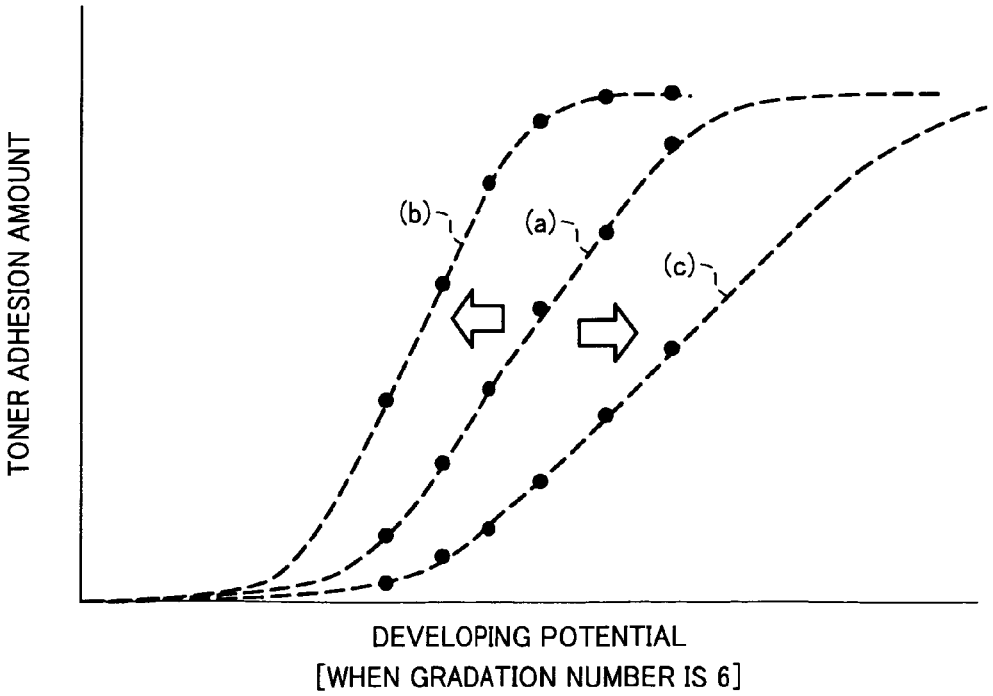
FIG. 10 illustrates a case wherein a gradation number is reduced moderately.

As illustrated above, when the gradation number is reduced, since the possibility increases that the error is included in the calculated development gamma γ, it is necessary to suppress the error as much as possible. FIG. 10 illustrates an example wherein the gradation number is reduced modestly in order to prevent the above-mentioned problem.

Here, in FIG. 10, since the gradation number is increased to 6, even when the development characteristic fluctuates, as in the cases of dotted-lines (b) and (c) of graph 10, virtually three plots are on the straight line of the halftone part. When there are 6 plots, it is comparatively easier to identify the reason for the plot dispersion, which may either be the error, or some plots approaching the inflection point of the development characteristic.

As illustrated above, when a comparatively large fluctuation in the development characteristic is judged in advance, the gradation number is preferably selected to be large. When a virtually ignorable fluctuation in the development characteristic is judged in advance, even if the gradation number is selected to be 3, the calculation of the development gamma γ is hardly influenced. One of the characteristics of the present invention is that the gradation number is made variable. In the embodiment of the present invention, in order to set the gradation number, the judgment of the development characteristic at the time is performed, which will be illustrated in detail hereinafter.

Trigger information to start the process control (information divided into different kinds, such as power-on status, when a predetermined number of paper is printed, when a predetermined time has lapsed, etc.) serves as factor information to set the gradation number (a condition to start a series of processing processes to set the gradation number). The process control is performed as follows. Since a machine state at the time can be estimated based on the trigger information to start the process control, an appropriate gradation number can be set.

Figure 11:
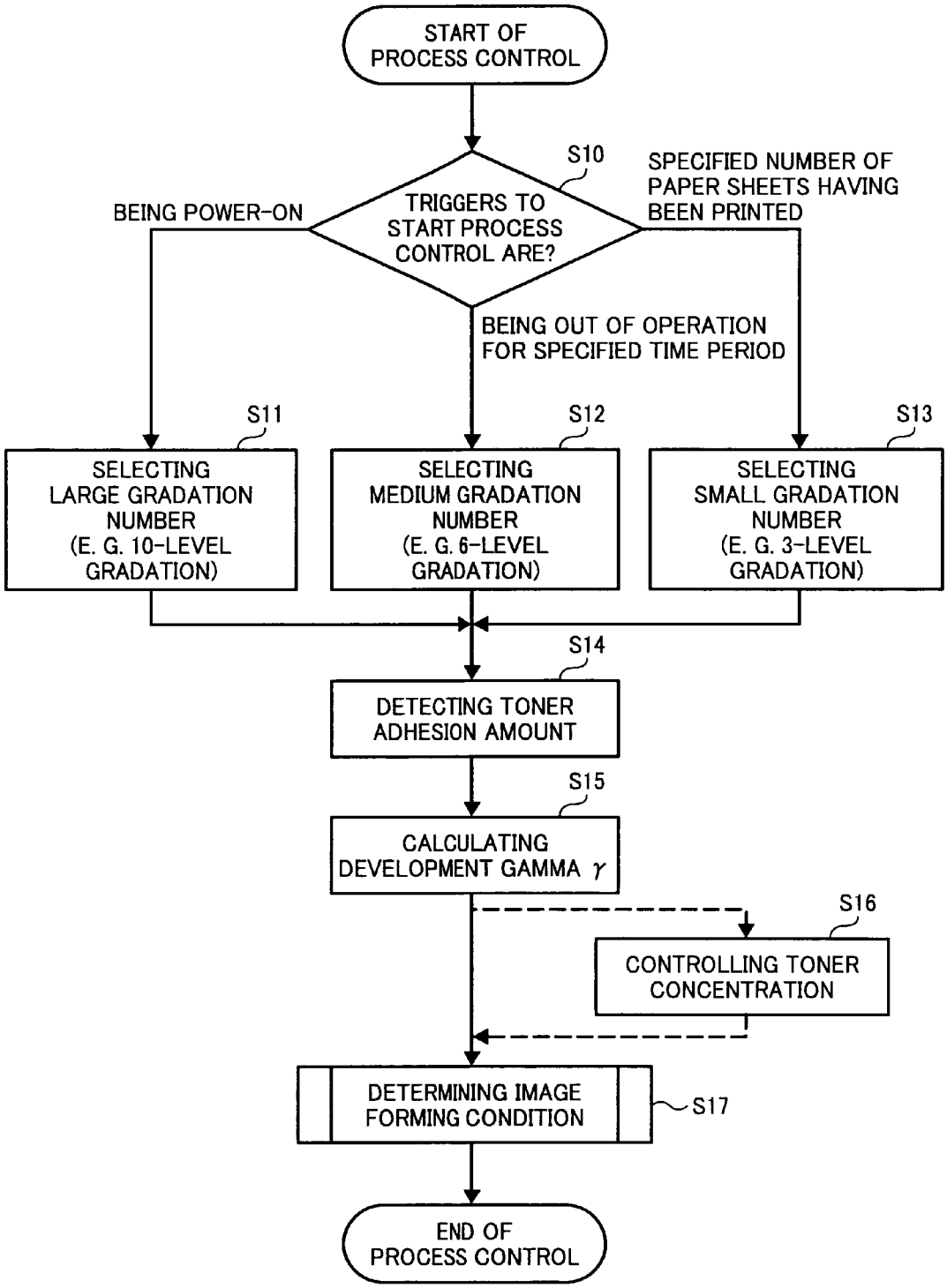
FIG. 11 is a flow chart illustrating the overall process control when trigger information (at the time of power-on, at the time of a specified number of paper sheets having been printed, at the time of the image forming apparatus being out of operation for a specified time period, etc.) at the time the process control is started is used as factor information.

Based on the above-mentioned trigger information, a flow chart of an overall process control is illustrated in FIG. 11.

Immediately after the process control is performed, a discrimination branch of triggers are available to start the process control (S10). The triggers to start the process control mainly include 1) at the time of being power-on, 2) at the time of a predetermined number of paper having been printed, 3) when the image forming apparatus is out of operation for a predetermined time period, corresponding to which a gradation pattern with a large gradation number (S11), a gradation pattern with a medium gradation number (S12), or a gradation pattern with a small gradation number (S13) is determined respectively. Here, three kinds of triggers are given. However, other kinds of triggers may exist, resulting in more branches in the flow chart of FIG. 11. In the above-mentioned three kinds of triggers, "2) when the predetermined number of paper is printed" is a trigger obtained in the course of the printing operation.

In this case, since a slight lag in timing is supposed to exist from the moment a CPU of the image forming apparatus recognizes the trigger, to the moment the process control is actually started (since there exists a condition of the control such as waiting until the printing operation is completed when the printing is being performed; such as performing the process control at a proper timing, or the like), generally, the process control is considered to be performed following the printing operation.

The CPU is used as a process control performing part constituting the image forming apparatus. Therefore, the image forming apparatus is considered to be in steady operational state, because of the following reasons. On the one hand, an office environment condition tends to be stable due to the air-conditioner being in use. On the other hand, the developer tends to be stirred sufficiently and the charge amount rises, which results in the development characteristic becoming steady, when the process control is performed following the printing operation being carried out. Since the development characteristic is considered to be in a stable state, the approximate straight line of the halftone part is likely to be obtained appropriately even by using the gradation pattern with a small gradation number. In addition, in the case of the 10-level gradation pattern, the developing potential is generally set to be a fixed value when the gradation pattern is formed. In the case of the gradation pattern with the small gradation number, when the value of the developing potential of the previous process control corresponding to a straight line area of the halftone part is used, the value of the development gamma γ can be obtained more securely.

The above-mentioned third trigger, i.e. "3) when the image forming apparatus is out of operation for a predetermined period" refers to the trigger obtained corresponding to a state wherein the image forming apparatus remains at power-on after the printing operation is completed. After a certain period of time lapses after the printing operation is completed, the charge amount of the developer is considered to be lowered to some extent. However, since the image forming apparatus is in the power-on state, the air-conditioner in the office is considered to be in operation. Therefore, since the environment condition of the apparatus is considered to be steady, the development characteristic is considered to be comparatively stable. Compared with the case of the second trigger, since the development characteristic may fluctuate more greatly, the gradation pattern with the medium gradation number (for example, a 6-level gradation pattern) is preferably selected, so as to calculate the slope of the halftone part more securely. Meanwhile, the first trigger, i.e. "at the time of being power-on" generally refers to the time when the apparatus is switched on at the start of operation in the morning. When the apparatus is in a power-off state, the environment condition may vary greatly. Since the air-conditioner is generally considered to be in a power-off state in the nighttime, for example, when in the rainy season or in the nighttime in summer, the humidity in the office may rise rather noticeably. In this case, since the development characteristic may fluctuate greatly due to the influence of the environment condition on the developer, the gradation pattern with the large gradation number (for example, the 10-level gradation pattern) is preferably selected, so as to obtain the toner image density of the halftone part.

As illustrated above, after the gradation number is selected (S11, S12, S13), the toner adhesion amount of the gradation patterns formed is detected (S14), and the development gamma γ value is calculated (S15). Thereafter, a toner concentration control (S16) may be performed (according to calculation results). Then, based on a previously prepared potential table, an image forming condition is determined (S17), and the operation of the process control is terminated. After the process control is performed at the start of the operation of the image forming apparatus, as illustrated above, the process control is also performed at an appropriate timing when the apparatus is in operation. However, this normal process control is not shown. Since the gradation number of the gradation pattern is determined and fixed, the process control is performed from the step of detecting the toner adhesion amount, rather than being performed from the conditional branches of S10, S11, S12, and S13, illustrated in FIG. 11 at the top of the flow chart.

As illustrated above, the triggers to start the process control can be divided into three kinds, such as 1) at the time of being power-on, 2) after a predetermined number of paper is printed, 3) after a lapse of predetermined time, etc. In the above-mentioned three kinds of triggers, "2) when the predetermined number of paper is printed" is the trigger obtained in the course of the printing operation. In this case, since the process control is started in the course of the printing operation, the image forming apparatus is considered to be in the steady operational state, because the developer tends to be stirred sufficiently, and the charge amount rises. Since the development characteristic is considered to be in a stable state, the development gamma γ is likely to be obtained appropriately even by selecting the gradation pattern with the small gradation number.

Meanwhile, the above-mentioned third trigger, i.e. "3) when the image forming apparatus is out of operation for a predetermined period" refers to the trigger obtained corresponding to the state wherein the image forming apparatus remains at power-on after the printing operation is completed. Since the humidity of the environment is considered not to vary greatly, the development characteristic is considered to be comparatively stable. Compared with the case of the second trigger, since the development characteristic possibly fluctuates more greatly, the gradation pattern with the medium gradation number (for example, the 6-level gradation pattern) is preferably selected, so as to calculate the slope of the halftone part more securely. The first trigger, i.e. "at the time of being power-on" generally refers to the time when the apparatus is switched on at the start of operation in the morning. When the apparatus is in the power-off state, since the environment condition may vary greatly, which may result in a great fluctuation in the charge characteristic of the toner, the gradation pattern with the large gradation number (for example, the 10-level gradation pattern) is preferably selected, so as to obtain the image density of the halftone part. Regardless of the gradation number, when a patch pattern of the halftone part, represented by several plots, can be formed as required by an actual situation, the development gamma γ can be calculated.

As illustrated above, since the machine state at a certain time point can be judged based on the triggers to start the process control, the proper gradation number can be determined. Since the gradation pattern with the minimum gradation number is selected and determined according to such a situation, the stability of the process control can be maintained and the reduction of both the toner consumption amount and the time for the process control can be realized. One of the factors to determine the gradation number can also be a lapse of time from the previous time when the process control is performed. As illustrated above, the process control is started by the various kinds of triggers. However, no matter which trigger starts the process control, in the case of the lapse of a short time since the previous process control is performed, the image forming condition corresponding to the development characteristic of the previous time is more likely to be suitable for the current situation. Conversely, in the case wherein the lapse of time since the previous process control is performed is long, the image forming condition corresponding to the development characteristic of the previous time is less likely to be suitable for the current situation, because various conditions may vary. Typically, when the process control is started by the first trigger, i.e. at the time of being power-on, when the lapse of time since the previous time of being power-on is long, the process control is performed based on the gradation pattern with the large gradation number. However, when the lapse of time since the previous time of being power-on is short, the process control is performed based on the gradation pattern with the small gradation number.

Figure 12:
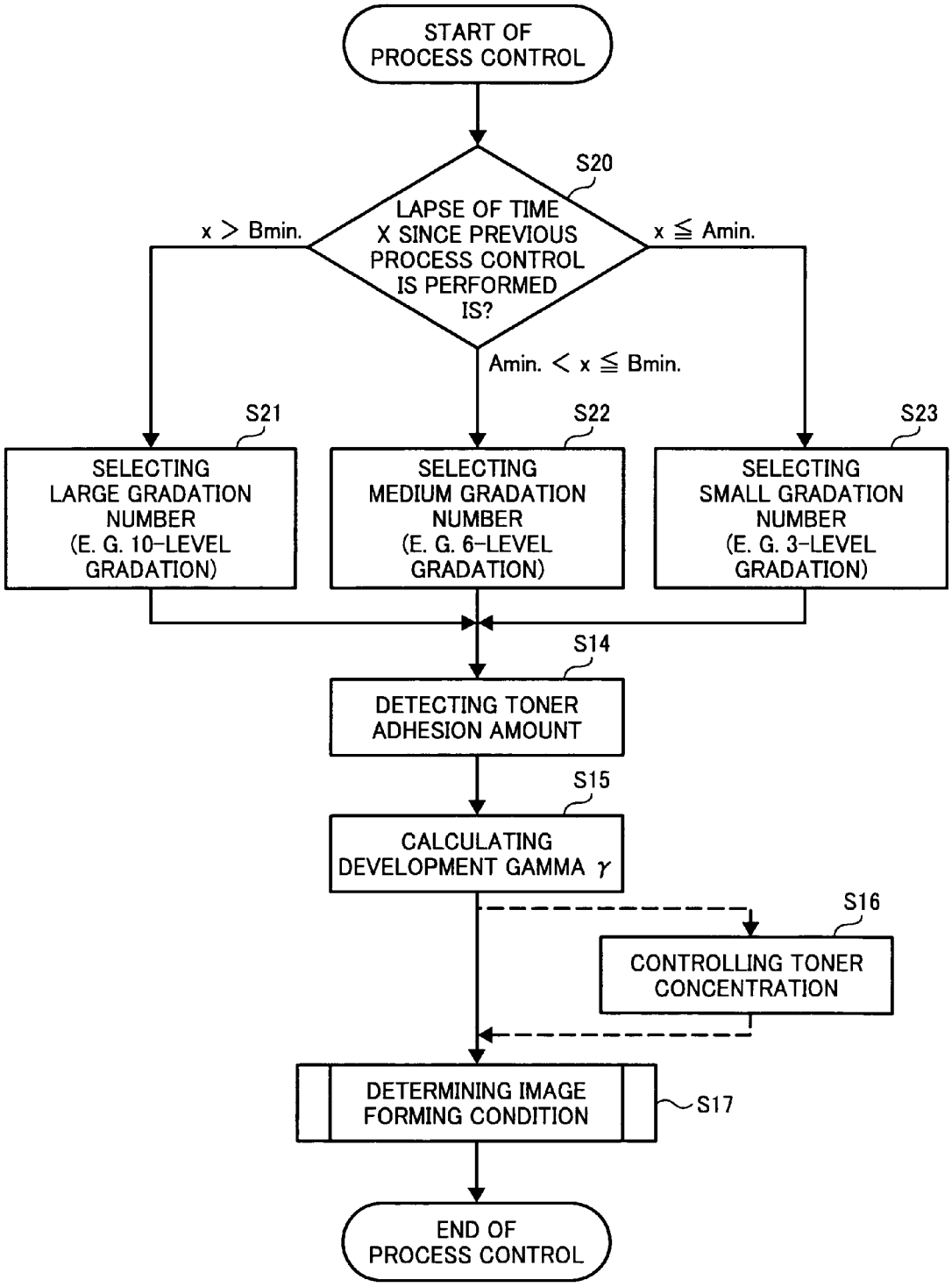
FIG. 12 is a flow chart illustrating an example of the process control, when information of a lapse of time since a previous process control is performed is used as the factor information.

FIG. 12 is a flow chart illustrating how the gradation number is determined based on such a lapse of time. Here, the conditional branches depending on the triggers (S10, S11, S12, and S13) in FIG. 11 are replaced by the lapse of time in FIG. 12. As illustrated above, the development characteristic fluctuates to some extent due to environment changes and deterioration of the developer and the photoreceptor. In the case wherein the lapse of time since the previous process control is performed is long, since the development characteristic is more likely to vary, the image forming condition corresponding to the development characteristic of the previous time is less likely to be suitable for the current situation. Therefore, the lapse of time X since the previous process control is performed is evaluated (S20). In the case wherein the lapse of time since the previous process control is performed is short (S23), since the development characteristic is less likely to vary, the gradation pattern with a small gradation number (for example, the 3-level gradation pattern) can be appropriate. Conversely, in the case wherein the lapse of time since the previous process control is performed is long (S21), since the development characteristic is more likely to vary, the gradation pattern with a large gradation number (for example, the 10-level gradation pattern) can be appropriate. In the case wherein the lapse of time since the previous process control is performed is neither too long nor too short (S22), the gradation pattern with a medium gradation number (for example, the 6-level gradation pattern) can be appropriate. The fluctuation in the development characteristic and the selection of the gradation number are illustrated as above. When the process control is performed as above, when the gradation pattern with the small gradation number is selected, the toner consumption amount can be reduced and the time for the process control can be shortened. Incidentally, the conditional branches depending on the triggers can also be followed by the conditional branches depending on the lapse of time, with which to perform the process control.

After the gradation number is selected, as illustrated in FIG. 11, the toner adhesion amount of the gradation patterns formed is detected (S14) and the development gamma γ value is calculated (S15). Thereafter, a toner concentration control (S16) may be performed (according to the calculation results). Then, based on the previously prepared potential table, the image forming condition is determined (S17), and the operation of the process control is terminated. One of the factors to determine the number of the gradation pattern can also be humidity information at the time of the process control being started. The electrophotographic image forming apparatus is heavily influenced by a humid environment inside and outside the image forming apparatus.

Since the humidity exerts influence mainly on electrification characteristics of a dry developer, based on the humidity information at the time of the process control being started, the development characteristic can be predicted to some extent. When the humidity is within a medium range (for example, from 40% RH to 60% RH), since the development characteristic is less likely to deviate from a typical value thereof, the gradation pattern with a small gradation number may be selected appropriately. When the humidity is low or high (for example, lower than 40% RH or higher than 60% RH), since the development characteristic may fluctuate greatly, the gradation pattern with a large gradation number is preferably selected, whereby even if the development characteristic may fluctuate, the development gamma γ can be calculated.

Figure 13:
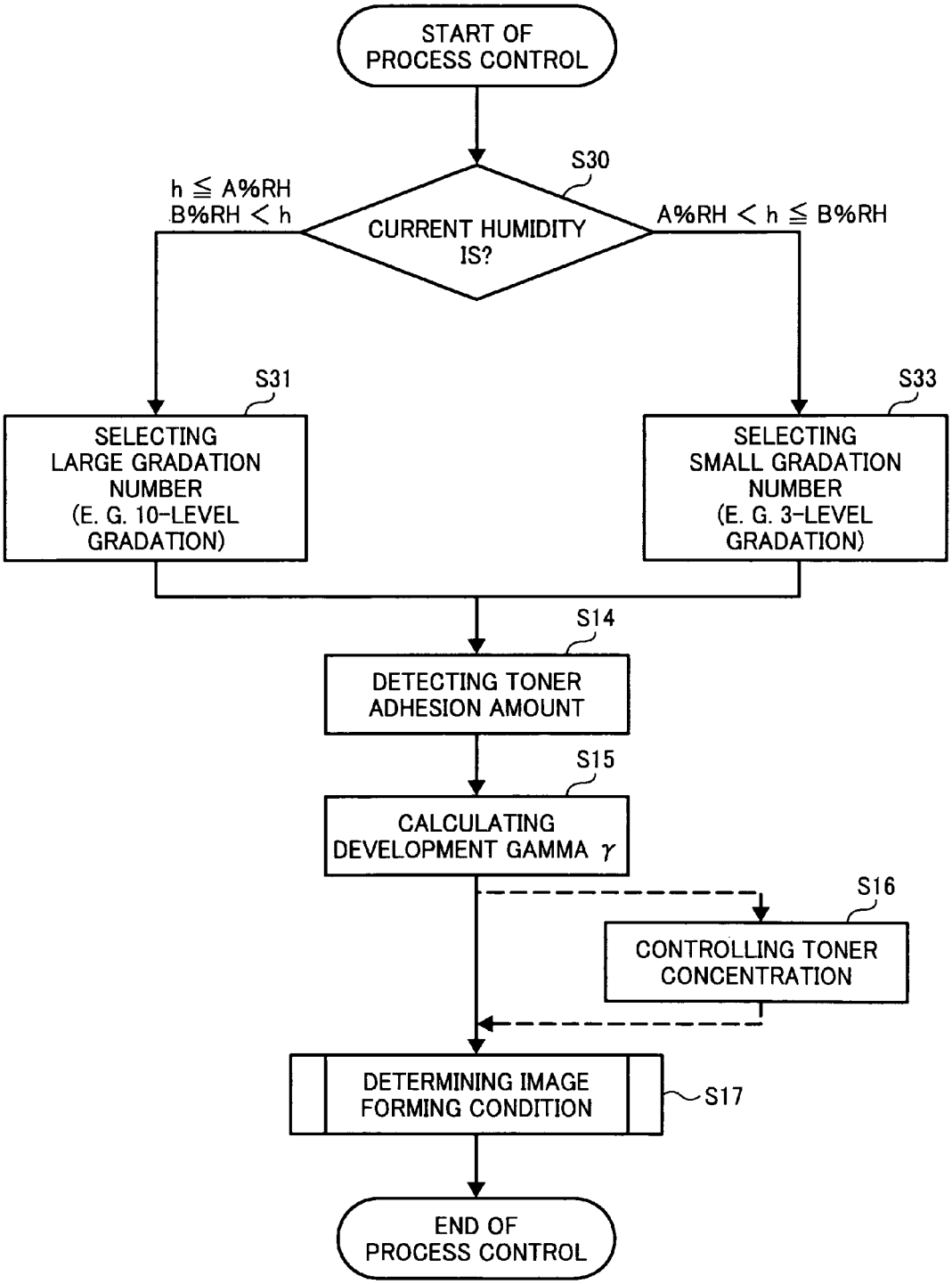
FIG. 13 is a flow chart illustrating an example of the process control, when humidity information at the time of the process control being started is used as the factor information.

FIG. 13 illustrates the case wherein the gradation number is determined by the humidity information at the time of the process control being started. Generally, the conditional branches in FIG. 11 are replaced by the humidity information. The humidity exerts a heavy influence, particularly on the developer. When the humidity is high, the charge amount of the developer is lowered. Conversely, when the humidity is low, the charge amount is raised. Therefore, the current humidity h is evaluated (S30). When the humidity is satisfactory (A % RH<h≦B % RH, for example, 40% RH<h≦60% RH), since the development characteristic can be forecasted to fluctuate slightly, the gradation pattern with a small gradation number, for example, the 3-level gradation pattern is selected (S33).

Conversely, when the humidity is not satisfactory (h≦A % RH or B % RH<h, for example, h<40% RH, or 60% RH≦h), the gradation pattern with a large gradation number, for example, the 10-level gradation pattern is selected (S31). As illustrated above, when the current humidity is of a medium degree, the gradation pattern with a small gradation number is selected. When the current humidity is high or low, the gradation pattern with a large gradation number is selected. After the gradation number is determined, the processing processes from S14 to S17 are all the same as those illustrated in FIG. 11 or FIG. 12. After the image forming condition (S17) is determined, the operation of the process control is terminated.

As illustrated above, via varying the gradation number according to the humidity condition, the stability of the process control can be maintained and the reduction of both the toner consumption amount and the time for the process control can be realized.

In addition, the process control can be performed based on humidity history information, instead of the above information of humidity. The influence of the humidity is mainly on the developer. Since the developer is a powder made of fine particles, the developer intrinsically absorbs and releases the moisture. In addition, it is rather time-consuming for the developer absorbing the moisture to release the absorbed moisture. Therefore, it may be rather time-consuming for the charging performance of the developer which is ever exposed to an environment of high humidity to revert to normal charging performance thereof. Considering such a characteristic of the developer, based on the humidity history information from the time when the previous process control is started until the current process control is started, in addition to the humidity information at the time of the process control being started, the present development characteristic can be estimated more appropriately.

Namely, the process control based on the humidity history information is performed when the image forming apparatus is in the power-on state, before which the environment conditions fluctuate greatly. Here, when the power is on, since the air conditioner in the office is considered to be in operation, the humidity in the vicinity of the image forming apparatus tends to be of medium level and hardly varies. However, since when the power is off, the air conditioner in the office is considered to be out of operation (for example, in the nighttime when staff members leave the office), the environment conditions in the vicinity of the image forming apparatus may vary sharply in different seasons. For example, when the dry developer absorbs the moisture undesirably in a high-humidity environment, even if the humidity in the vicinity of the apparatus is of medium level, it is rather time-consuming for the developer to release the absorbed moisture.

Considering the above, even if the process control is started in the medium-humidity environment when the power is on, the development characteristic may also be undesirably influenced significantly if the image forming apparatus is placed in the high-humidity environment when the power is off. In such a case, the gradation pattern with a large gradation number is selected to calculate the development gamma γ securely. Based on the calculation results, a correction is performed via a potential adjustment or a toner concentration control. When the humidity history is hardly varied, since the development characteristic of the developer hardly varies, the gradation pattern with a small gradation number can be selected.

Figure 14:
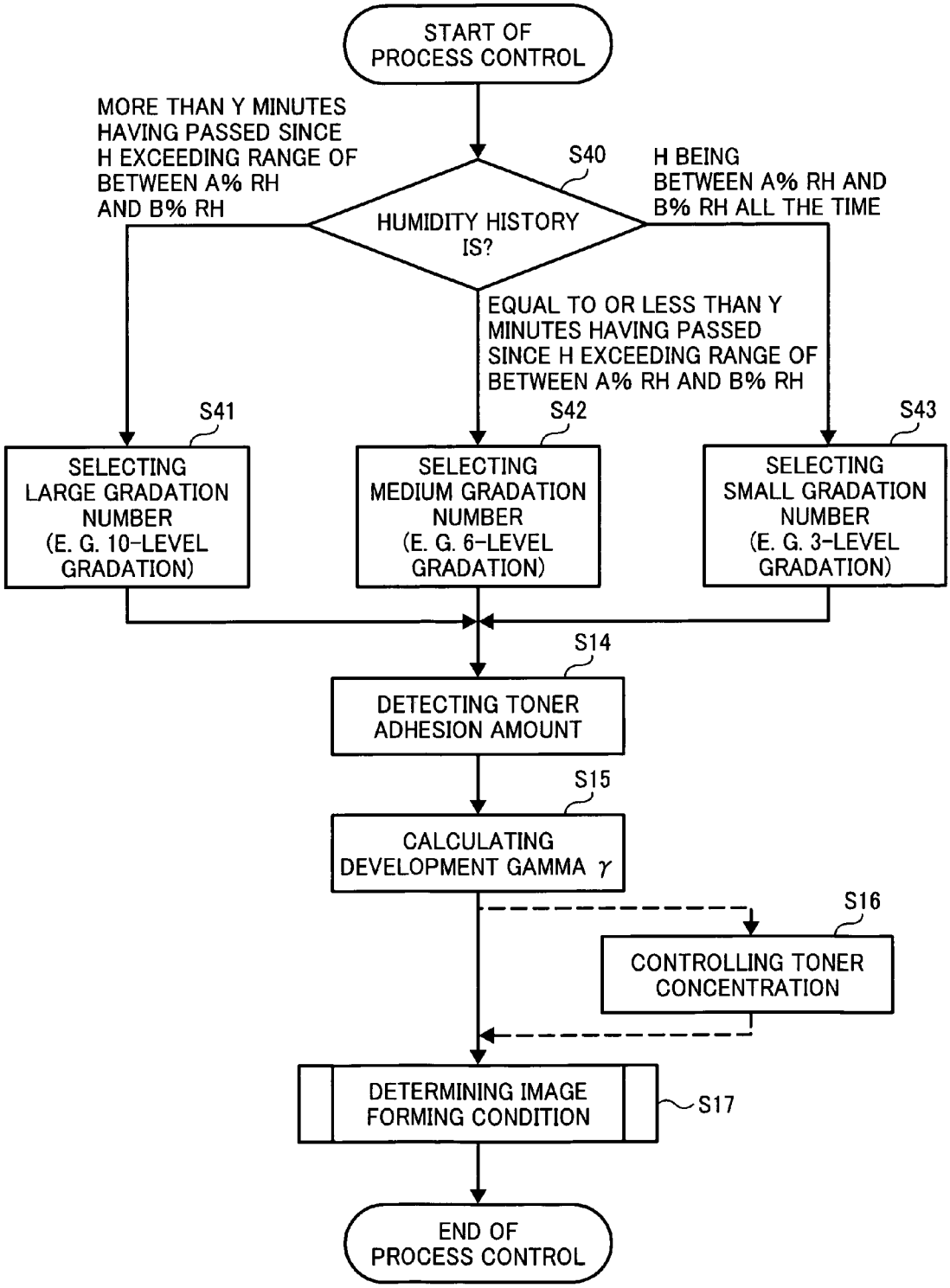
FIG. 14 is a flow chart illustrating an example of the process control, when humidity history information is considered.

FIG. 14 illustrates a flow chart based on the humidity history information. Here, conditional branches (S40) are three branches, divided as 1) being in the medium-humidity environment all the time, 2) being out of the medium-humidity environment for a short time, 3) being out of the medium-humidity environment for a long time. In the case of 1), a gradation pattern with a small gradation number is selected (S43). In the case of 2), a gradation pattern with a medium gradation number is selected (S42). In the case of 3), a gradation pattern with a large gradation number is selected (S41). In addition to the conditional branches divided simply as above, a more detailed division can also be made with respect to the conditional branches, based on a lapse of time in the case wherein the image forming apparatus is returned to the medium-humidity environment after being out of the medium-humidity environment. According to the embodiment of the present invention, when the humidity history information is considered, the division of the conditional branches is not confined to only the above. After the gradation number is selected, the processing processes from S14 to S17 are performed in the same way as those illustrated in FIG. 11 or FIG. 12, but are omitted here for simplicity. As illustrated above, when the humidity history information, instead of the humidity information is used, the influence of the humidity can be reflected more precisely. As illustrated above, the stability of the process control can be maintained and when the gradation patterns with a small gradation number are selected, the toner consumption amount can be reduced and the time for the process control can be shortened.

According to the embodiment of the present invention, a humidity sensor is used to determine the gradation number based on the humidity information. The humidity sensor is preferably arranged in the vicinity of the developing device of the image forming apparatus, because as illustrated above, in the image forming apparatus, the toner is most susceptible to the humidity. Although the position of the humidity sensor is not confined, particularly, the humidity sensor is preferably arranged in the vicinity of an opening part of the developing device. Since the toner at a developing nip part is exposed out of the developing device, the toner is considered to be most susceptible to the humidity in the vicinity of the developing nip part. Therefore, the humidity sensor is preferably arranged in the vicinity of the developing nip part.

As illustrated above, in the image forming apparatus, since the toner is most susceptible to the humidity, the humidity sensor is arranged in the vicinity of the developing device, whereby the influence of the humidity on the toner can be considered appropriately. Thus, since the degree of the fluctuation in the development characteristic can be estimated in advance, the gradation number can be selected appropriately. In addition, in the image forming apparatus, since the toner is most susceptible to the humidity, when the humidity sensor is arranged inside of the developing device, where the toner is stored, the humidity condition can be detected most directly. Therefore, the humidity sensor can also be arranged inside of the developing device, whereby the humidity can be measured satisfactorily. However, in this case, in order to prevent the fine powders of the toner from being stirred up, a configuration of the humidity sensor needs to be considered. For example, for the prevention of the above problem, a filter with smaller holes than the fine powders of the toner can be provided. When the humidity sensor is arranged inside of the developing device, more room can be saved. In this case, the humidity sensor is made small and compact. Based on the configuration of the developing device, the humidity sensor can be arranged at an upper wall, or the like of a side of toner conveyance screws. As illustrated above, the humidity sensor can be arranged in the above-mentioned positions, whereby the influence of the humidity on the charge characteristic of the toner can be appropriately estimated in advance. Therefore, the corresponding development characteristic can also be estimated in advance appropriately. Therefore, since the gradation number corresponding to the estimated development characteristic can be selected more appropriately, a failure of the process control due to an excessive reduction in the gradation number can be prevented. Meanwhile, the toner consumption amount can be reduced and the time required for the process control can be shortened.

As illustrated above, when a multi-color toner image is formed, gradation pattern images (a plurality of rectangular region arrays), arrayed corresponding to the respective colors in the conveyance direction of the intermediate transfer belt, are formed in the width direction of the intermediate transfer belt. However, the gradation pattern images formed according to the embodiment of the present invention are not confined as illustrated above. FIG. 15 is a top view illustrating the intermediate transfer belt 50, the optical sensor 500, and an example wherein gradation patterns (detection patterns) of each color are formed sequentially in a same position on the intermediate transfer belt 50 in the width direction thereof, according to another embodiment of the present invention.

In this embodiment, in the case of a full-color image forming apparatus, in a normal state as a default, constituent images of the 10-level gradation pattern of each color are all serially formed (in a predetermined position as one row in the conveyance direction of the intermediate transfer belt). The optical sensor 500 is arranged in a position corresponding to a position of the gradation pattern image, formed in one row (one rectangular region array), as illustrated in FIG. 15. Concerning the optical sensor 500, one sensor head 500*b* is installed in a position where the gradation pattern image is formed, on the single sensor substrate 500*a*. Thus, in the full-color image forming apparatus, only one sensor head is arranged, whereby a simpler configuration is realized.

Figure 16:
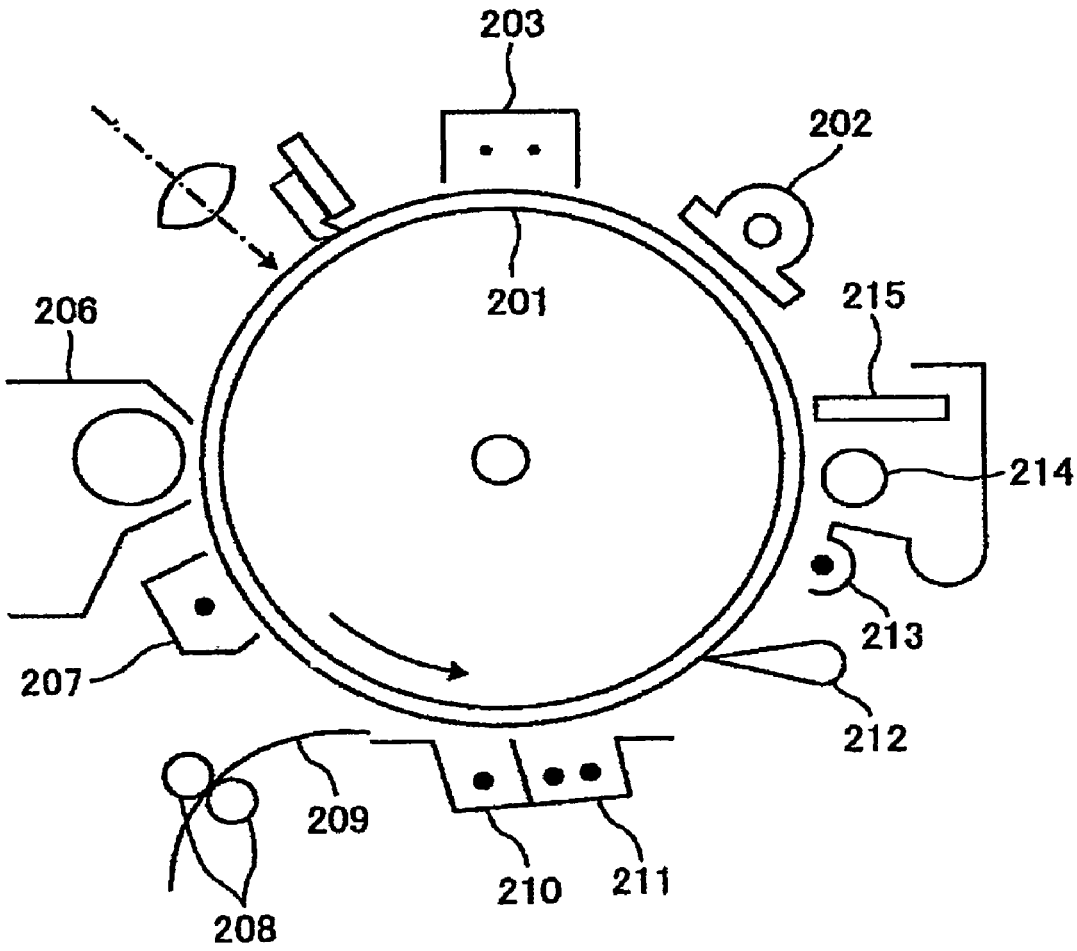
FIG. 16 is a schematic view illustrating a monochromatic image forming apparatus with a direct transfer system, according to another embodiment of the present invention.

In the case of such a simpler configuration as illustrated above, based on various factor information at the time of the process control being started, when the fluctuation in current development characteristic can be determined to be adequately small, a gradation number of a gradation pattern is reduced (the gradation number is reduced to be smaller than 10). In addition, the present invention can also be applied to other apparatuses besides the full-color image forming apparatus. For reference, an example wherein the present invention is applied to other apparatuses besides the full-color image forming apparatus, will be illustrated hereinafter. FIG. 16 shows a schematic configuration of a monochromatic image forming apparatus with the direct transfer system (monochromatic copying machine). In FIG. 16, although a drum-shaped photoreceptor 201 is illustrated, the photoreceptor 201 can also be of a sheet-like shape or an endless belt shape. A colotron device, a scolotron device, a solid-state discharging element, a needle electrode device, a roller charging device, a conductive brush device, or the like can serve as a charger 203, to uniformly electrify the photoreceptor 201. The heretofore known contact-type electrification method or the proximity electrification method can be used.

A developing unit 206 is used to visualize an electrostatic latent image formed on the photoreceptor 201. The developing method includes the one-component developing method where the dry toner is used, the two-component developing method, and the wet development method using the wet toner. When the positive (negative) electrification is executed on the photoreceptor 201 and the exposure is performed, a positive (negative) electrostatic latent image is formed on the surface of the photoreceptor 201. When the electrostatic latent image is developed by using a negatively (positively) polarized toner, a positive image is obtained; whereas when a positively (negatively) polarized toner is used, a negative image is obtained. A transfer charger 210 is used to transfer the visualized toner image on the photoreceptor 201, onto a recording medium 209. In order to perform better transfer, a pre-transfer charger 207 can also be used. Transfer systems can be used which include an electrostatic transfer system using the transfer charger and a bias roller; a mechanical transfer system such as a sticking transfer system, a pressure transfer system, or the like; and a magnetic transfer system. The electrostatic transfer system may be used in the above-mentioned charger.

A separating charger 211 and a separating claw 212 are used as devices to separate the recording medium 209 from the photoreceptor 201. Separation methods such as an electrostatic absorption induction separation, a side belt separation, a forefront gripper conveyance, a curvature separation, or the like can also be used. The separation charger 211 can be the above-mentioned charger. After the toner image is transferred, in order to remove the residual toner on the photoreceptor 201, a fur brush 214 and a cleaning blade 215 are used. In addition, in order to perform the removal of the residual toner more efficiently, a pre-cleaning charger 213 can also be used. Other cleaning units such as a cleaning unit of a web system, or a cleaning unit of a magnetic brush system can also be used, together or separately. In addition, when necessary, a neutralization device is used so as to remove the latent image on the photoreceptor 201. The neutralization device can be a discharging lamp 202 or a discharging charger, which can be an exposure light source or the charger respectively. In addition, processes of reading the document when not close to the photoreceptor, paper feeding, fixing, paper ejecting, etc. can be hitherto known processes.

With the above-mentioned configuration of the monochromatic image forming apparatus with the direct transfer system, as illustrated in the embodiment of full-color image forming apparatus, corresponding to various factor information, when the process control is started, the gradation number of a patch pattern to be formed is determined, when the process control is performed. For example, as illustrated in the embodiment of the full-color image forming apparatus, the trigger information of starting the process control, such as at the time of being in a power-on status, at the time of a predetermined number of paper having been printed, after a lapse of predetermined time, etc.), may serve as the factor information at the time of the gradation number being determined (a condition of starting a series of processing processes to determine the gradation number). The same effects can be expected in the case of the monochromatic image forming apparatus with the direct transfer system.

Although the illustration concerning the present invention is made as above, the image forming apparatus and the process control method thereof can also be extensively applied to the field of electrophotography. For example, the image forming apparatus and the process control method thereof can also be applied to a laser beam printer, a CRT printer, an LED printer, a liquid crystal printer, laser plate making, etc., in addition to the electrophotographic copying machine.

According to an embodiment of the present invention, some effects can be obtained as follows. Since the gradation number is made variable, the minimum gradation number is determined according to the state of the image forming apparatus. Therefore, the stability of the control can be maintained and the reduction both in the toner consumption amount and in the time for the process control can be realized.

Although the present invention has been described in terms of exemplary embodiments, it is not limited thereto. It should be appreciated that various changes and modifications can be made to the embodiments by persons skilled in the art without departing from the scope of the present invention as defined by the following claims.

What is claimed is:

1. An image forming apparatus, comprising:

a patch pattern forming part to form an image of a patch pattern on an image carrier;

a developing part to develop the image of the patch pattern;

an image density detecting part to measure an image density of the patch pattern; and a process control performing part to vary an image forming process condition based on detection results obtained from the image density detecting part, and to stabilize the image density, wherein, corresponding to various factor information, the process control performing part is configured to set a gradation number of the image of the patch pattern and the detection results obtained from the image density detecting part to stabilize the image density are associated with a development gamma of a halftone of the patch pattern.

2. The image forming apparatus according to claim 1, wherein the process control performing part uses trigger information as the factor information, so as to set the gradation number of the patch pattern.

3. The image forming apparatus according to claim 2, wherein the trigger information includes information relating to the image forming apparatus being powered on, being out of operation for a specified period of time, and a number of paper sheets having been printed.

4. The image forming apparatus according to claim 3, wherein the image forming apparatus is configured to generate the patch pattern having a first gradation number in the event the trigger is associated with being powered on, is configured to generate the patch pattern having a second gradation number in the event the trigger is associated with being out of operation for the specified period of time, and is configured to generate the patch pattern having a third gradation number in the event trigger is associated with the number of sheets having been printed, and the first gradation number is larger than the second gradation number and the second gradation number is larger than the third gradation number.

5. The image forming apparatus according to claim 1, wherein the process control performing part uses information of lapse of time since a previous process control is performed, as the factor information, so as to set the gradation number of the patch pattern.

6. The image forming apparatus according to claim 5, wherein the image forming apparatus is configured to generate a patch pattern having a first gradation number if the lapse of time is greater than a first value, is configured to generate a patch pattern having a second gradation number if the lapse of time is smaller than a second value, and is configured to generate a patch pattern having a third gradation number if the lapse of time is greater than the second value and smaller than or equal to the first value, wherein the first value is greater than the second value.

7. The image forming apparatus according to claim 6, wherein the first gradation number is greater than the third gradation number and the third gradation number is greater than the second gradation number.

8. The image forming apparatus according to claim 1, wherein the process control performing part uses humidity information at a time of the process control being started as the factor information, so as to set the gradation number of the patch pattern.

9. The image forming apparatus according to claim 8, wherein a humidity sensor is arranged in the vicinity of the developing part.

10. The image forming apparatus according to claim 9, wherein the humidity sensor is arranged inside of the developing part.

11. The image forming apparatus according to claim 1, wherein the detection results obtained from the image density detecting part to stabilize the image density are associated with only the halftone of the patch pattern regardless of the gradation number.

12. An image forming apparatus, comprising:

a patch pattern forming part to form an image of a patch pattern on an image carrier;

a developing part to develop the image of the patch pattern;

an image density detecting part to measure an image density of the patch pattern; and a process control performing part to vary an image forming process condition based on detection results obtained from the image density detecting part, and to stabilize the image density, wherein, corresponding to various factor information, the process control performing part is configured to set a gradation number of the image of the patch pattern, and the process control performing part uses humidity history information from the time the previous process control is started as the factor information, so as to set the gradation number of the patch pattern.

13. The image forming apparatus according to claim 12, wherein a humidity sensor is arranged in the vicinity of the developing part.

14. The image forming apparatus according to claim 13, wherein the humidity sensor is arranged inside of the developing part.

15. A process control method, comprising:

setting a gradation number of a patch pattern to be formed corresponding to various factor information;

forming a toner image of the patch pattern on an image carrier;

developing the patch pattern;

measuring a toner image density of the patch pattern by a toner image density detecting part; and varying an image forming process condition to stabilize an image density according to detection results obtained from the toner image density detecting part, wherein varying the image forming process condition to stabilize the image density according to the detection results obtained from the toner image density includes estimating a development gamma of a halftone of the patch pattern.

16. A program for a process control method, comprising: a computer to execute the steps according to claim 15.

17. A recording medium, which records the program according to claim 16 and is read by the computer.

* * * * *